US009908362B2

(12) United States Patent
Yasumi

(10) Patent No.: US 9,908,362 B2
(45) Date of Patent: Mar. 6, 2018

(54) LIQUID APPLYING CONTAINER

(71) Applicant: TOKIWA Corporation, Gifu (JP)

(72) Inventor: Risa Yasumi, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 18 days.

(21) Appl. No.: 15/224,733

(22) Filed: Aug. 1, 2016

(65) Prior Publication Data

US 2017/0036478 A1 Feb. 9, 2017

(30) Foreign Application Priority Data

Aug. 4, 2015 (JP) ..... 2015-154081

(51) Int. Cl.

| | |
|---|---|
| ***B43M 11/06*** | (2006.01) |
| ***B43K 8/02*** | (2006.01) |
| ***B43K 8/08*** | (2006.01) |
| ***B43K 1/00*** | (2006.01) |

(52) U.S. Cl.

CPC ..... *B43K 8/026* (2013.01); *B43K 1/003* (2013.01); *B43K 8/08* (2013.01)

(58) Field of Classification Search

CPC ..... B43K 8/026; B43K 8/022; B43K 8/024; B43K 8/08; B43K 1/003

USPC ..... 401/198

See application file for complete search history.

(56) References Cited

U.S. PATENT DOCUMENTS 4,208,145 A * 6/1980 Azuma ..... B43K 1/003 401/196
4,824,271 A * 4/1989 Nagahama ..... B43K 1/003 401/196

FOREIGN PATENT DOCUMENTS

JP 5999791 7/1984
JP 2015080856 A 4/2015

* cited by examiner

*Primary Examiner* — Jennifer C Chiang
(74) *Attorney, Agent, or Firm* — Isshiki International Law Office; Joseph P. Farrar

(57) ABSTRACT

A liquid applying container includes a container main body housing an impregnated body impregnated with a liquid, an applying body having an applying portion for applying liquid, and an applying body holder into which the applying body is inserted and which supports the applying body. The applying body holder includes one or more supporting portions in a rear portion of the applying body holder that are disposed so as to be along a direction of insertion of the applying body and supporting the rear portion of the applying body so as to sandwich or wrap the rear portion of the applying body, the one or more supporting portions having an opening formed at a rear end of the one or more supporting portions, with the one or more supporting portions advancing into the impregnated body or the impregnated body advancing into the one or more supporting portions.

13 Claims, 19 Drawing Sheets

LIQUID APPLYING CONTAINER

CROSS-REFERENCE TO RELATED APPLICATIONS

The present application is based on and claims priority pursuant to 35 U.S.C. § 119 to Japanese Patent Application No. 2015-154081, filed on Aug. 4, 2015, the entire disclosure of which is hereby incorporated herein by reference.

The present disclosure relates to a liquid applying container for applying a liquid.

BACKGROUND

A marking pen described in Patent Document 1 below is known as a conventional container for applying a liquid. The marking pen of Patent Document 1 is as follows. In related art, when a pen body as an applying body is introduced and inserted into an ink storage body as an impregnated body housed in a container, the pen body bends because the pen body is formed by a fibrous body, for example, and is thus soft. The marking pen is made in light of a problem of a resulting difficulty in assembly work. The marking pen adopts a constitution in which a pen body retaining member having a bottomed tubular shape and having a pointed rear end is provided, the pen body is fitted into and retained by the pen body retaining member, the pen body retaining member is inserted into the ink storage body, slit-shaped notch portions extending in an axial direction and making the inside and outside communicate with each other are provided in side walls (peripheral walls) of the pen body retaining member to expose the pen body from the notch portions, and the exposed part is advanced into the ink storage body. According to the marking pen, the pen body retaining member internally retaining the pen body is inserted into the ink storage body without the soft pen body being directly inserted into the ink storage body. Thus, an ink as a liquid is transmitted from the ink storage body through the notch portions in the side walls of the pen body retaining member.

On the other hand, an applicator described in Patent Document 2 is known in which an impregnated body pierces an applying body in contrast to Patent Document 1. The applicator adopts a constitution in which the impregnated body is a rod-shaped paint feeder, a rear end portion of the paint feeder is dipped in a paint as a liquid housed in a paint tank within a container, and a front end portion of the paint feeder is thrust and inserted into a brush as the applying body. The paint in the paint tank is supplied to the brush through the paint feeder.

PRIOR ART DOCUMENT

Patent Documents

[Patent Document 1]
Japanese Utility Model Laid-Open No. 1984-99791
[Patent Document 2]
Japanese Patent Laid-Open No. 2015-80856

BRIEF SUMMARY

However, according to Patent Document 1, the ink goes around from the notch portions in the side walls of the pen body retaining member, advances into the inside, and then moves straight forward to the front end of the pen body. Thus, a resistance acts on the flow of the ink. It is therefore difficult for the ink to move smoothly. In addition, in a case where the pen body is a thin soft flat-shaped plate material, it is more difficult to make the ink, whose smooth movement is difficult as described above, further move evenly and smoothly from a circumferential direction of the pen body retaining member through the notch portions into the internal pen body.

On the other hand, according to Patent Document 2, the ink moves smoothly when the ink is moved from the paint tank through the paint feeder to the brush. However, in a case where the brush is a thin soft flat-shaped plate material, even when the front end portion of the paint feeder is to be thrust and inserted into the thin soft flat-shaped plate material, the plate material is flimsy, and thus escapes from the front end portion of the paint feeder to be inserted. Thus, the front end portion of the paint feeder cannot be inserted well. There is consequently a fear that the ink cannot be supplied to the plate material.

Accordingly, in view of Patent Documents 1 and 2, it is desired that in a case where a plate-shaped applying body is adopted, a liquid such as the ink or the paint be smoothly and surely moved from the impregnated body such as the ink storage body or the paint feeder to the plate-shaped applying body.

It is accordingly an object of the present disclosure to provide a liquid applying container that can make a liquid in an impregnated body move to a plate-shaped applying body surely and smoothly.

According to the present disclosure, there is provided a liquid applying container including: a container main body internally housing an impregnated body impregnated with a liquid; an applying body having an applying portion for applying the liquid, and exhibiting capillarity that takes in the liquid from the impregnated body and guides the liquid to the applying portion; and an applying body holder into which the applying body is inserted and which supports the applying body. The applying body includes a tip portion in which the applying portion is formed and which projects outward from the container main body and a rear portion that takes in the liquid from the impregnated body. The applying body is formed in a shape of a plate. The applying body holder includes one or a plurality of supporting portions in a rear portion of the applying body holder, the one or a plurality of supporting portions being disposed so as to be along a direction of insertion of the applying body and supporting the rear portion of the applying body so as to sandwich or wrap the rear portion of the applying body, the one or a plurality of supporting portions having an opening formed at a rear end of the one or a plurality of supporting portions, and the one or a plurality of supporting portions advancing into the impregnated body or the impregnated body advancing into the one or a plurality of supporting portions.

According to such a liquid applying container, in the case where the one or a plurality of supporting portions of the rear portion of the applying body holder advance into the impregnated body impregnated with the liquid, the one or a plurality of supporting portions advance into the impregnated body while the rear portion of the applying body having a plate shape and exhibiting capillarity is supported so as to be sandwiched or wrapped by the one or a plurality of supporting portions. Thus, the rear portion of the applying body is easily inserted into the impregnated body without being bent, while protected by the one or a plurality of supporting portions. Therefore, the liquid in the impregnated body can be surely moved to the applying body, and the liquid flows straight forward through the opening at the rear end of the one or a plurality of supporting portions, so that the liquid in the impregnated body can be moved smoothly. In addition, in the case where the impregnated body advances into the one or a plurality of supporting portions in the rear portion of the applying body holder, the impregnated body advances through the opening at the rear end of the one or a plurality of supporting portions. In this state, the rear portion of the applying body is supported so as to be sandwiched or wrapped by the one or a plurality of supporting portions. Thus, the impregnated body that has advanced into the one or a plurality of supporting portions is easily inserted into the rear portion of the applying body without the rear portion of the applying body escaping. Therefore, the liquid in the impregnated body can be surely moved to the applying body, and the liquid flows straight forward through the opening at the rear end of the one or a plurality of supporting portions, so that the liquid in the impregnated body can be moved smoothly.

Various applying bodies can be adopted as the applying body exhibiting capillarity. Specifically, however, a constitution formed of a fibrous material can be adopted as the applying body suitably producing the above-described action.

In addition, in the case where the one or a plurality of supporting portions advance into the impregnated body, the impregnated body is preferably an inner cotton. When such a constitution is adopted, the one or a plurality of supporting portions of the applying body holder are harder than the inner cotton. Therefore the one or a plurality of supporting portions supporting the rear portion of the applying body can be surely inserted into the inner cotton.

In addition, when the applying body projects rearward from the opening at the rear end of the applying body holder, an area of contact of the applying body with the inner cotton is increased, so that a larger amount of liquid can be moved to the applying body.

In addition, in the case where the one or a plurality of supporting portions support the rear portion of the applying body so as to wrap the rear portion of the applying body, when the one or a plurality of supporting portions have a liquid advancing slit in side surfaces of the one or a plurality of supporting portions, the liquid advancing slit communicating with the opening at the rear end and extending frontward, the liquid in the inner cotton advances into the one or a plurality of supporting portions through the liquid advancing slit. Thus, a larger amount of liquid can be moved to the applying body.

In addition, in the case where the impregnated body advances into the one or a plurality of supporting portions, the impregnated body is preferably a relay core. When such a constitution is adopted, the applying body touching a skin is softer than the relay core. Thus, the relay core can be surely inserted into a rear end surface of the rear portion of the applying body supported so as to be sandwiched or wrapped by the one or a plurality of supporting portions of the applying body holder.

In addition, when the relay core has a projection at a front end of the relay core, and a rear end surface of the applying body has a depression into which the projection of the relay core advances, the projection of the relay core can be surely inserted and advanced into the depression of the rear end surface of the applying body.

In addition, in the case where the one or a plurality of supporting portions support the rear portion of the applying body so as to sandwich the rear portion of the applying body, when a slit communicating with the opening at the rear end and extending frontward is provided between the one or a plurality of supporting portions, and the applying body holder has a stopper against which the applying body passing the slit from a rear side to a front side is butted, the applying body abuts against the stopper of the applying body holder. Thus, the applying body is positioned easily, and the applying body is prevented from advancing further. The applying body can thereby be prevented from slipping out frontward while cleaning such as taking dirt off the applying body is performed.

Various liquids can be adopted as the liquid. Specifically, however, because the applying body has a plate shape and exhibits capillarity, the liquid is preferably an eyeliner cosmetic material.

Advantageous Effects

Thus, according to the present disclosure, it is possible to provide a liquid applying container that can make the liquid in the impregnated body move to the plate-shaped applying body smoothly and surely.

DETAILED DESCRIPTION

Preferred embodiments of a liquid applying container according to the present disclosure will hereinafter be described with reference to FIGS. 1 to 19. FIGS. 1 to 9 show a first embodiment of the present disclosure. FIGS. 10 to 19 show a second embodiment of the present disclosure. In the figures, identical elements are identified by the same reference symbols, and repeated description thereof will be omitted.

The first embodiment shown in FIGS. 1 to 9 will be described first.

Figure 1:
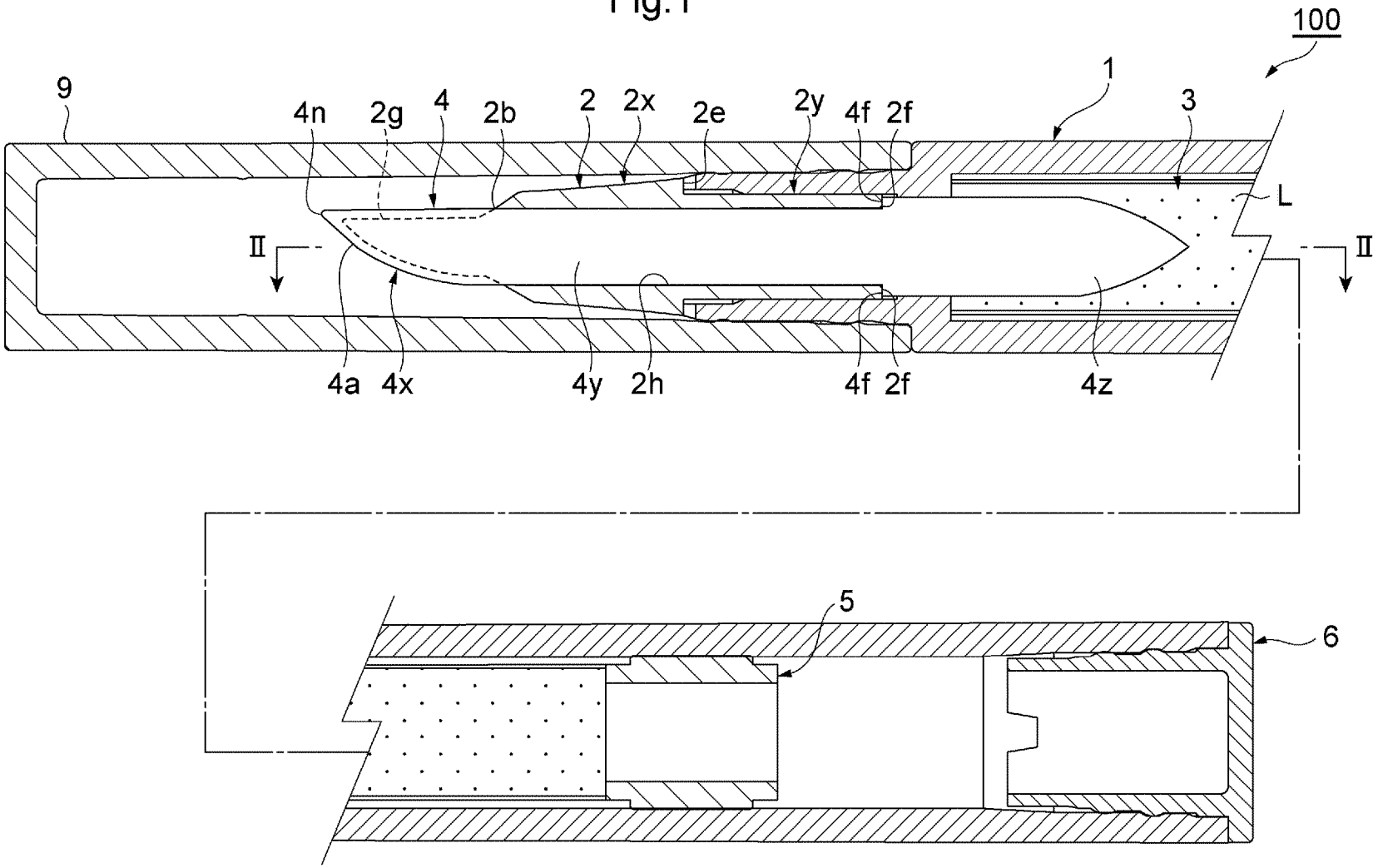
FIG. 1 is a longitudinal sectional view of a liquid applying container according to a first embodiment of the present disclosure.
Figure 2:
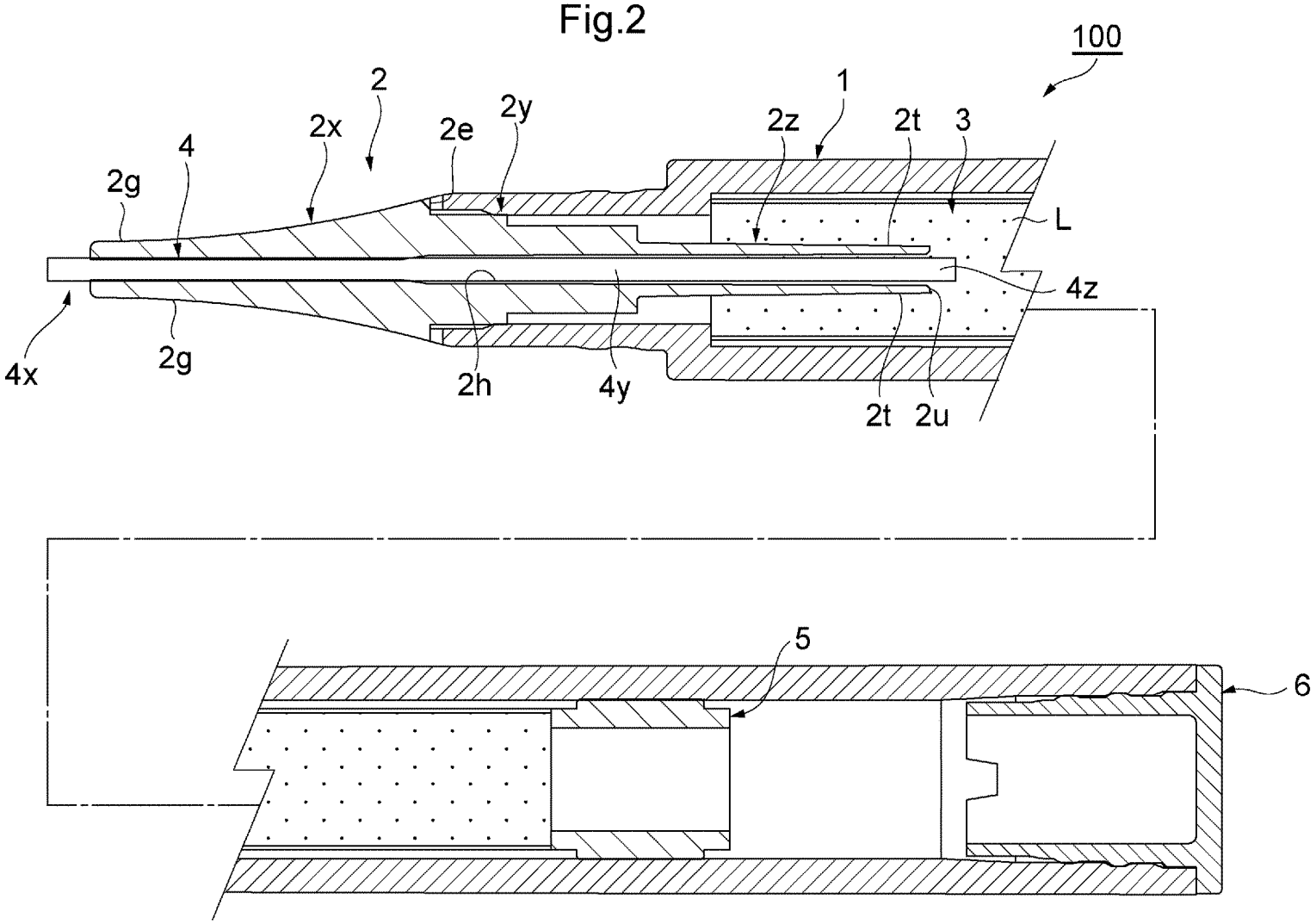
FIG. 2 is a view taken along a line II-II of FIG. 1 in the direction of the arrows.
Figure 3:
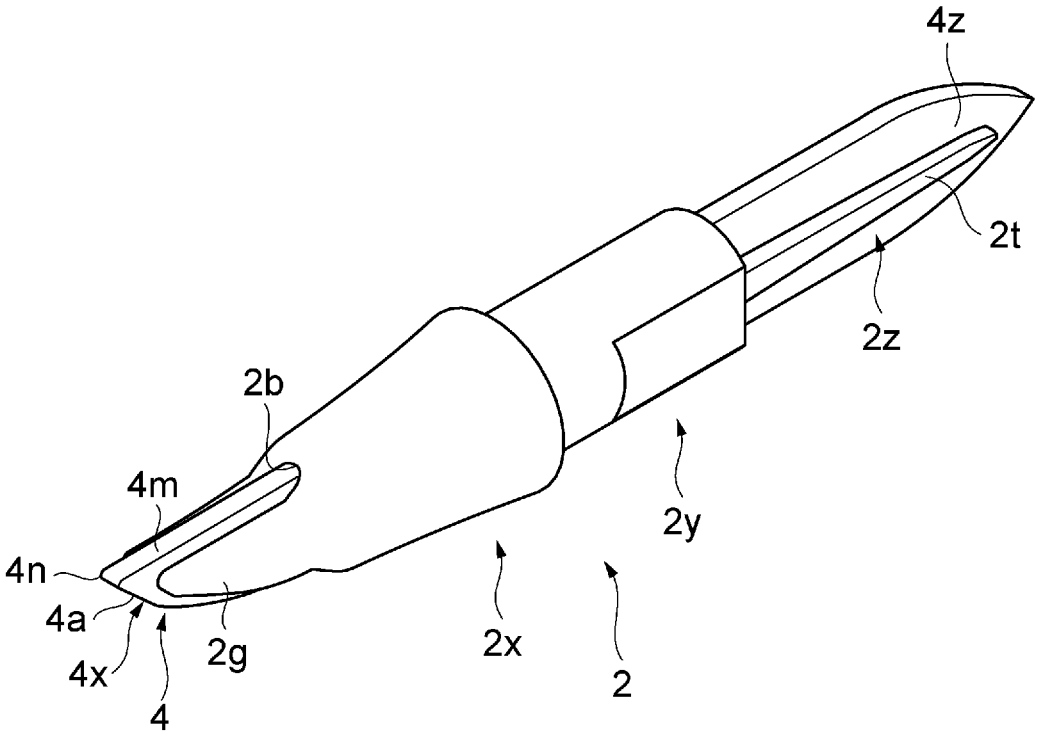
FIG. 3 is a perspective view of an applying body and an applying body holder in FIG. 1 and FIG. 2 as viewed from the front.
Figure 4:
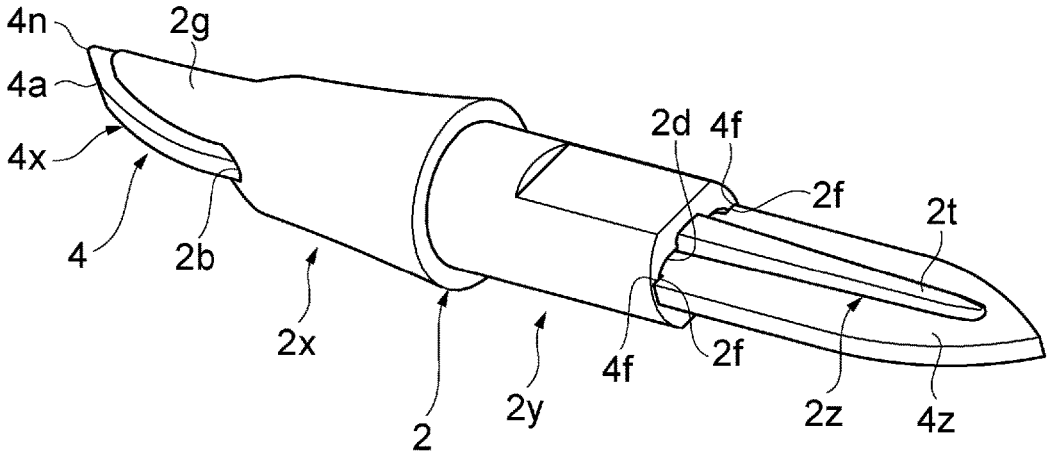
FIG. 4 is a perspective view of the applying body and the applying body holder shown in FIG. 3 as viewed from the rear.
Figure 5:
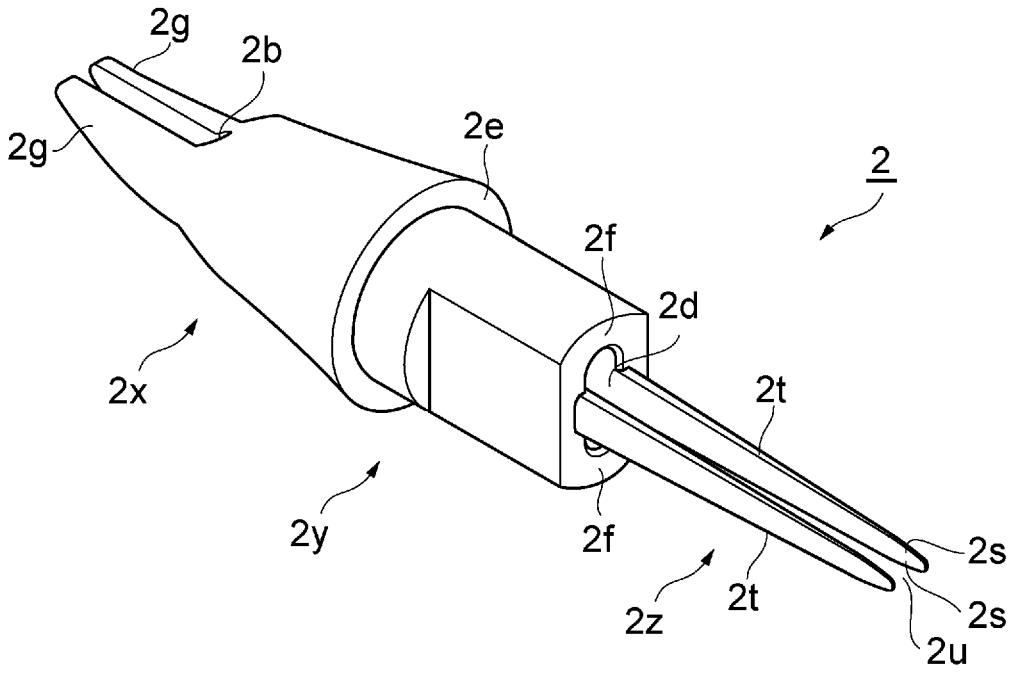
FIG. 5 is a perspective view of the applying body holder in FIG. 1 and FIG. 2 as viewed from the rear.
Figure 6:
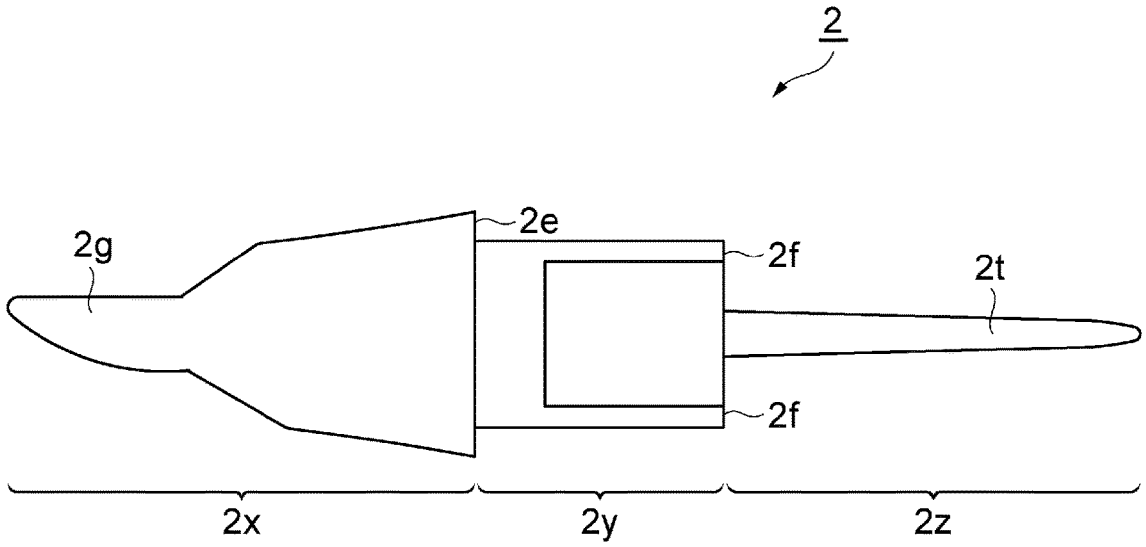
FIG. 6 is a side view of the applying body holder shown in FIG. 5.
Figure 7:
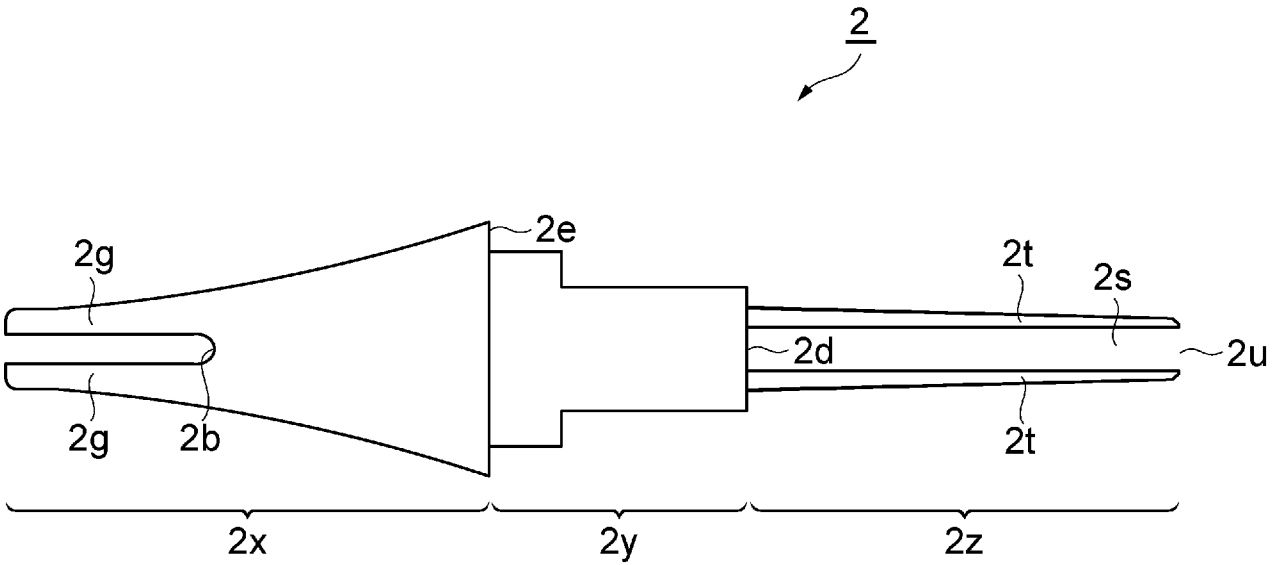
FIG. 7 is a plan view of the applying body holder shown in FIG. 6.
Figure 8:
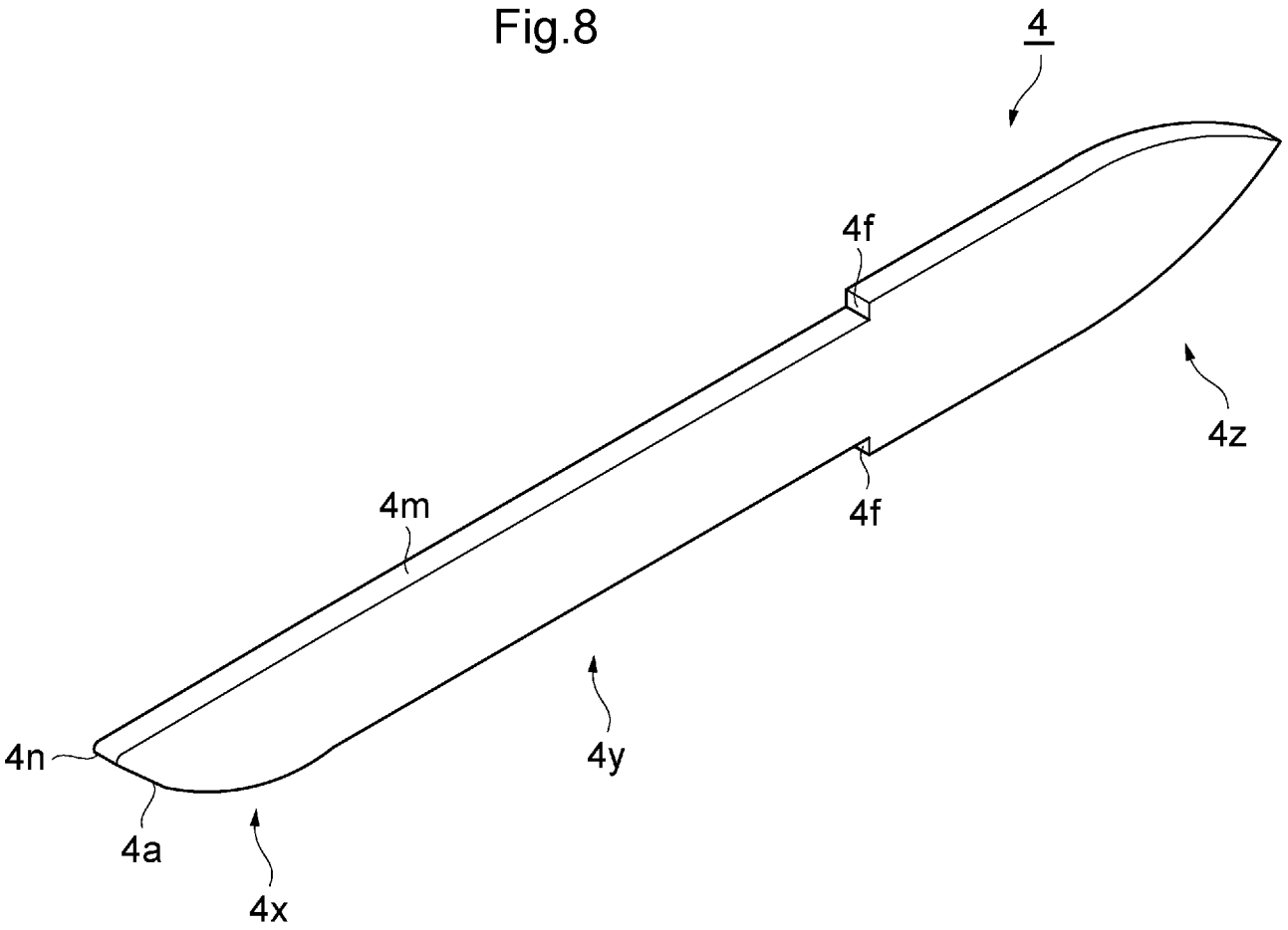
FIG. 8 is a perspective view of the applying body in FIG. 1 and FIG. 2.
Figure 9:
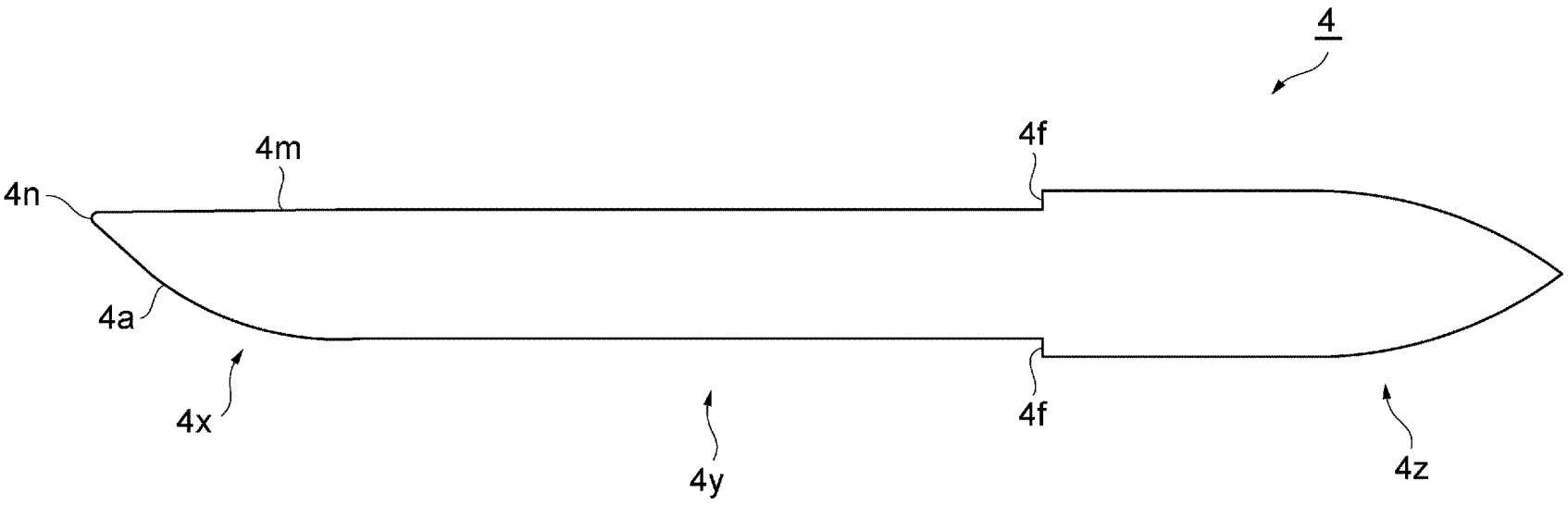
FIG. 9 is a side view of the applying body shown in FIG. 8.

FIG. 1 and FIG. 2 are sectional views of a liquid applying container according to the first embodiment of the present disclosure. FIG. 3 and FIG. 4 are perspective views of an applying body and an applying body holder. FIGS. 5 to 7 are diagrams of the applying body holder. FIG. 8 and FIG. 9 are diagrams of the applying body. The liquid applying container according to the present embodiment can be used by a user to apply a liquid contained within the liquid applying container to a portion to which to apply the liquid as appropriate. The liquid in this case is particularly preferably an eyeliner cosmetic material, which is a liquid cosmetic material for drawing a line of eyeliner. Hence, the liquid applying container in this case is an eyeliner cosmetic material applying container.

As shown in FIG. 1 and FIG. 2, an eyeliner cosmetic material applying container 100 includes a container main body 1 and a leading tube 2 forming an external shape of the container, an inner cotton 3 as an impregnated body housed within the container main body 1, and a flat applying body 4 housed within the container main body 1 and the leading tube 2, and projecting from an opening at a front end of the leading tube 2.

The container main body 1 is for example formed of polypropylene (PP) or the like, and is configured in the shape of a tapered stepped cylinder. An opening at a rear end of the container main body 1 is closed by fitting a tail plug 6 formed for example of PP or the like into the rear end of the container main body 1. The inner cotton 3 impregnated with an eyeliner cosmetic material L is filled into an internal space formed so as to have an increased diameter in the rear of a stepped surface of an outer circumferential surface of the container main body 1. The inner cotton 3 is formed for example of polyester or the like, and has a long cylindrical shape. The size of the inner cotton 3 can be adjusted by an adjuster 5 disposed at a rear end of the inner cotton 3, the adjuster 5 being formed for example of high-density polyethylene (HDPE) or the like.

The leading tube 2 is an applying body holder into which the applying body 4 is inserted and which supports the applying body 4 (the leading tube 2 will hereinafter be referred to as an applying body holder 2). The applying body holder 2 is formed for example of PP or the like. As shown in FIGS. 5 to 7, the applying body holder 2 includes a tip portion 2*x* on a front end side, a rear portion 2*z* on a rear end side, and an intermediate portion 2*y* between the tip portion 2*x* and the rear portion 2*z*. As shown in FIG. 1 and FIG. 2, the tip portion 2*x* projects from the container main body 1, and the intermediate portion 2*y* and the rear portion 2*z* are housed within the container main body 1.

A rear half portion of the tip portion 2*x* and the intermediate portion 2*y* are formed in a tubular shape. A tube hole 2*h* penetrating the rear half portion of the tip portion 2*x* and the intermediate portion 2*y* has a shape capable of housing an intermediate portion 4*y* (see FIG. 8 and FIG. 9: to be described later in detail) of the flat applying body 4, that is, a substantially rectangular cross-sectional shape corresponding to the shape of the intermediate portion 4*y* of the applying body 4.

As shown in FIGS. 5 to 7, the outer circumferential surface on the rear end side of the tip portion 2*x* has a circular shape, and the tip portion 2*x* has a tapered shape that is reduced in diameter such that the circular shape changes into a flat shape toward the front end side. An opening 2*b* at the front end of the tapered shape is an exit for the applying body 4, the exit being continuous with and similar in shape to the tube hole 2*h* of the substantially rectangular cross-sectional shape (see FIG. 1, FIG. 3, and FIG. 4). A pair of projecting portions 2*g* opposed to each other which projecting portions project forward of opening edges on a long diameter side (direction perpendicular to the paper plane of FIG. 7) of the opening 2*b* as the exit is provided at opening edges on a short diameter side (vertical direction of FIG. 7) of the opening 2*b*. The projecting portions 2*g* and 2*g* are tip portion supporting portions that sandwich and support a tip portion 4*x*, which will be described later, of the applying body 4 from both sides (the projecting portions 2*g* will hereinafter be referred to as tip portion supporting portions 2*g*). The tip portion supporting portions 2*g* have such a shape as to be substantially along an outer edge of the tip portion 4*x* of the applying body 4 (shape of the outer edge of the tip portion 4*x* of the applying body 4 will be described later).

The outer circumferential surface of the intermediate portion 2*y* has a small-diameter circular shape continuous with the rear end of the tip portion 2*x* via a stepped surface 2*e*. The intermediate portion 2*y* is a block body extending rearward by a predetermined length. An opening 2*d* as an exit of the tube hole 2*h* having the substantially rectangular cross-sectional shape which tube hole penetrates the intermediate portion 2*y* is opened in a rear end surface of the intermediate portion 2*y*. Parts of the rear end surface of the intermediate portion 2*y* having the opening 2*d*, which parts are on the periphery of the opening 2*d*, or more specifically on the periphery on the long diameter side of the opening 2*d*, form stoppers 2*f* against which stoppers 4*f* (to be described later in detail) of the applying body 4 abut when the applying body 4 is assembled.

The rear portion 2*z* has a pair of projecting portions 2*t* and 2*t* that are connected to the rear end surface of the intermediate portion 2*y* so as to be disposed along a direction of insertion of the applying body 4, and which project rearward. The projecting portions 2*t* and 2*t* are rear portion supporting portions that sandwich and support a rear portion 4*z*, which will be described later, of the applying body 4 from both sides (the projecting portions 2*t* will hereinafter be referred to as rear portion supporting portions 2*t*). Each of the rear portion supporting portions 2*t* is configured in the form of a flat plate, and has a shape tapered toward the rear end side. The rear portion supporting portions 2*t* and 2*t* are configured to project rearward from about centers of opening edges on a short diameter side (vertical direction of FIG. 7) of the opening 2*d*. In other words, a slit (gap) 2*s* is formed between an edge portion on one side (upper side in FIG. 5) of one rear portion supporting portion 2*t* and an edge portion on one side (upper side) of the other rear portion supporting portion 2*t*. A similar slit 2*s* is also formed between an edge portion on the other side (lower side in FIG. 5) of the one rear portion supporting portion 2*t* and an edge portion on the other side (lower side in FIG. 5) of the other rear portion supporting portion 2*t*. These slits 2*s* and 2*s* are opposed to each other and communicate with each other. In addition, a rear end between the rear portion supporting portions 2*t* and 2*t* is opened rearward, thus forming an opening 2*u*.

The applying body 4 is used to apply the eyeliner cosmetic material L along the edge of an eye. The applying body 4 is referred to also as a tip. As shown in FIG. 8 and FIG. 9, the applying body 4 is formed in the shape of a thin flat plate, and extends in an axial direction. The applying body 4 has an optimum thickness for drawing a thin line of eyeliner. The applying body 4 exhibits capillarity that takes in the eyeliner cosmetic material L with which the inner cotton 3 is impregnated and guides (moves) the eyeliner cosmetic material L to an applying portion 4*a* on the front end side. The applying body 4 in this case is formed of polyolefin so as to provide a skin-conforming soft touch at a time of application.

Incidentally, it suffices for the applying body 4 to be able to at least exhibit capillarity. However, the applying body 4 preferably provides a soft touch. A soft fibrous material or a soft porous material such as a sponge can be employed as the applying body 4. The applying body 4 may also be formed for example of nylon, polyester, or the like other than polyolefin. Incidentally, the applying body 4 is more preferably formed of a fibrous material.

This applying body 4 includes a tip portion 4*x* on the front end side, a rear portion 4*z* on the rear end side, and an intermediate portion 4*y* between the tip portion 4*x* and the rear portion 4*z*.

The tip portion 4*x* is a part projecting from the opening 2*b* of the applying body holder 2 (see FIG. 1). As viewed in plan (as viewed in a direction perpendicular to the paper plane of FIG. 9), the tip portion 4*x* assumes the shape of a tip portion (point) of the single-edged shape of for example a kitchen knife or the like. Specifically, as for the shape of an outer edge of the tip portion 4*x*, as viewed in plan, a part 4*m* corresponding to a so-called back that is a part on the back side of an edge of the single-edged shape is formed in a linear shape. A front end of the linear shape forms a sharp portion 4*n* pointed at an acute angle. As with the part of a so-called curve of the edge, a part from the sharp portion 4*n* toward the rear forms a curved inclined surface 4*a* that is curved and inclined. Then, the curved inclined surface 4*a* curved with a small thickness forms an applying portion for drawing a line of eyeliner (the curved inclined surface 4*a* will hereinafter be referred to as an applying portion 4*a*).

Incidentally, in this case, as a shape particularly preferable for applying the eyeliner cosmetic material L, the sharp portion 4*n* is disposed so as to be offset to one side (upper side in FIG. 9) in a width direction (vertical direction of FIG. 9) as viewed in plan as in the single-edged shape. However, the sharp portion 4*n* may be disposed at a center in the width direction as in a double-edged shape. In addition, while the applying portion 4*a* is curved and inclined, the applying portion 4*a* may be inclined linearly.

Both intermediate side surfaces in the axial direction (upper and lower surfaces in FIG. 9) of the intermediate portion 4*y* have stepped surfaces 4*f* where the rear end side is enlarged outward in the width direction with respect to the front end side. The intermediate portion 4*y* is thus a flat plate in which a part in the rear of the stepped surfaces 4*f* is wider in the width direction than a part in front of the stepped surfaces 4*f*. The stepped surfaces 4*f* form stoppers that abut against the stoppers 2*f* of the applying body holder 2 when the applying body 4 is assembled to the applying body holder 2 (the stepped surfaces 4*f* will hereinafter be referred to as stoppers 40.

The rear portion 4*z* is a part that advances into the inner cotton 3 and which takes in the eyeliner cosmetic material L (see FIG. 1 and FIG. 2). As viewed in plan, the rear portion 4*z* assumes the shape of a tip portion of a double-edged shape, for example. Specifically, a center in the width direction of a rear end of the rear portion 4*z* is formed so as to be pointed toward the rear in order to be easily inserted into the inner cotton 3.

As shown in FIG. 3 and FIG. 4, the flat applying body 4 is inserted from the tip portion 4*x* into the opening 2*d* in the rear end surface of the intermediate portion 2*y* of the applying body holder 2. As shown in FIG. 1 and FIG. 4, the stoppers 4*f* as the stepped surfaces of the flat applying body 4 abut against the stoppers 2*f* of the intermediate portion 2*y* of the applying body holder 2. The flat applying body 4 is thus positioned and prevented from advancing further.

In this state, as shown in FIGS. 1 to 4, the tip portion 4*x* of the applying body 4 projects from the opening 2*b* of the tip portion 2*x* of the applying body holder 2, and is sandwiched and supported from both sides by the tip portion supporting portions 2*g* and 2*g* of the applying body holder 2, the tip portion supporting portions 2*g* and 2*g* having such an outer edge shape as to be substantially along (substantially a smaller similar shape to) the outer edge shape of the tip portion 4*x* of the applying body 4.

In addition, the rear portion 4*z* of the applying body 4 projects rearward from the opening 2*d* in the rear end surface of the intermediate portion 2*y* of the applying body holder 2, and is sandwiched and supported from both sides by the rear portion supporting portions 2*t* and 2*t* of the applying body holder 2, the rear portion supporting portions 2*t* and 2*t* forming the shape of a flat plate and extending rearward. In this state, the rear portion 4*z* of the applying body 4 projects so as to protrude slightly rearward from the rear portion supporting portions 2*t* and 2*t* of the applying body holder 2, and projects so as to protrude greatly in the vertical direction from the rear portion supporting portions 2*t* and 2*t* of the applying body holder 2.

Then, as shown in FIG. 1 and FIG. 2, the applying body holder 2 thus integrated with the applying body 4 is inserted from the rear portion supporting portions 2*t* and 2*t* side of the applying body holder 2 into a tube hole in a cylindrical front end portion of the container main body 1. The stepped surface 2*e* of the applying body holder 2 is butted against a front end surface of the container main body 1. The outer circumferential surface in the rear of the stepped surface 2*e* is fitted to an inner circumferential surface of the front end of the container main body 1. The applying body holder 2 supporting the applying body 4 is thereby fitted to the container main body 1.

In this state, the rear portion 4*z* of the applying body 4 which rear portion is sandwiched and supported by the rear portion supporting portions 2*t* and 2*t* of the applying body holder 2 has been advanced and inserted into the inner cotton 3. The applying body 4 is prevented from moving forward by the stoppers 2*f* of the applying body holder 2, and is prevented from moving rearward by the inner cotton 3. The applying body 4 is thus positioned in the axial direction thereof.

When the applying body holder 2 supporting the applying body 4 is thus fitted to the container main body 1, the eyeliner cosmetic material applying container 100 shown in FIG. 1 and FIG. 2 is obtained. Incidentally, as shown in FIG. 1, a cap 9 is detachably fitted to the eyeliner cosmetic material applying container 100 so as to cover the applying body 4.

In the thus formed eyeliner cosmetic material applying container 100, the capillarity of the applying body 4 causes the eyeliner cosmetic material L with which the inner cotton 3 is impregnated to be taken in from the rear portion 4*z* of the applying body 4, move in the applying body 4, and further move to the applying portion 4*a* of the tip portion 4*x*. Therefore a thin line of eyeliner can be drawn by the applying portion 4*a* with a soft touch.

Such an eyeliner cosmetic material applying container 100, in particular, produces the following action and effect. Because of the constitution in which the rear portion supporting portions 2*t* and 2*t* of the rear portion 2*z* of the applying body holder 2 advance into the inner cotton 3 while the rear portion 4*z* of the applying body 4 having the shape of a flat plate and exhibiting capillarity is sandwiched and supported by the rear portion supporting portions 2*t* and 2*t* (see FIG. 2), the rear portion 4*z* of the applying body 4 is easily inserted into the inner cotton 3 without being bent, while protected by the rear portion supporting portions 2*t* and 2*t*. Therefore, the eyeliner cosmetic material L in the inner cotton 3 can be surely moved to the applying body 4, and the eyeliner cosmetic material L flows straight forward through the opening 2*u* at the rear end of the rear portion supporting portions 2*t* and 2*t*, so that the eyeliner cosmetic material L in the inner cotton 3 can be moved smoothly.

In addition, according to the present embodiment, because the rear portion supporting portions 2*t* and 2*t* of the applying body holder 2 are harder than the inner cotton 3, the rear portion supporting portions 2*t* and 2*t* can be surely inserted into the inner cotton 3.

In addition, because the applying body 4 projects rearward from the opening 2*u* of the rear end of the applying body holder 2 (see FIG. 2), the applying body 4 has a large area of contact with the inner cotton 3. Thus, a larger amount of eyeliner cosmetic material L can be moved to the applying body 4.

In addition, the slits 2*s* and 2*s* communicating with the opening 2*u* at the rear end of the applying body holder 2 and extending frontward are provided between the rear portion supporting portions 2*t* and 2*t* of the applying body holder 2, and the applying body holder 2 has the stoppers 2*f* and 2*f* against which to butt the applying body 4 that passes the slits 2*s* and 2*s* from the rear side to the front side (see FIG. 5). Thus, because the stoppers 4*f* and 4*f* of the applying body 4 abut against the stoppers 2*f* and 2*f* of the applying body holder 2 (see FIG. 1), the applying body 4 is positioned easily, and the applying body 4 is prevented from advancing further. The applying body 4 can thereby be prevented from slipping out frontward while cleaning such as taking dirt off the applying body 4 is performed in the state of the eyeliner cosmetic material applying container 100 shown in FIG. 1 and FIG. 2.

The present embodiment further produces the following action and effect. Because the applying body 4 is formed in the shape of a thin flat plate to draw a thin line of eyeliner, and provides a soft touch, the applying body 4 is flimsy, and, as it is, presents a problem in that the tip portion 4*x* of the applying body 4 is bent by a stroke pressure when a line of eyeliner is drawn. In the present embodiment, however, the tip portion 4*x* of the applying body 4 is sandwiched and supported from both sides by the tip portion supporting portions 2*g* and 2*g* of the applying body holder 2, the tip portion supporting portions 2*g* and 2*g* having such an outer edge shape as to be substantially along the outer edge shape of the tip portion 4*x* (see FIG. 3 and FIG. 4). The tip portion 4*x* of the applying body 4 can therefore be prevented from being bent by a stroke pressure when a line of eyeliner is drawn. Because the tip portion 4*x* of the applying body 4 can be thus prevented from being bent when a line of eyeliner is drawn, a beautiful thin line of eyeliner having a desired width can be easily drawn by the applying portion 4*a* along the edge of an eye.

The present inventor conducted a three-point bending test in which a compact tabletop tester EZTest (manufactured by Shimadzu Corporation) was used and a load was applied to a test specimen having a width of 3 mm and a length of 30 mm in a thickness direction of the test specimen, with a distance of 20 mm between supporting points and with a crosshead speed of 20 mm/minute. The present inventor has consequently found that an applying body having a material and thickness such that a load of 0.17 N or less is applied when an amount of deflection of the applying body is 4 mm is an applying body that is soft and which provides an excellent applying feeling. According to such a test, it is shown that softness can be ensured when the material for the applying body is polyolefin and the thickness of the applying body is set to 1 mm or less, and that the thickness of the applying body is more preferably set to 0.7 mm or less from a viewpoint of softness.

Incidentally, in the first embodiment, as a particularly preferable example, the rear portion 4*z* of the flat applying body 4 is supported so as to be sandwiched by the rear portion supporting portions 2*t* and 2*t* of the applying body holder 2. However, a part of the rear portion 4*z* of the applying body 4 which part is exposed to the outside without being sandwiched by the rear portion supporting portions 2*t* and 2*t* of the applying body holder 2 may be covered, and supported such that the entire periphery of the rear portion 4*z* of the applying body 4 is wrapped. Such a constitution also produces action and effect substantially similar to those in the case where the rear portion 4*z* of the applying body 4 is sandwiched and supported by the rear portion supporting portions 2*t* and 2*t* of the applying body holder 2. Incidentally, in the case where the rear portion supporting portions thus support the part of the rear portion 4*z* of the applying body 4 which part is exposed to the outside so as to wrap the entire periphery of the rear portion 4*z* of the applying body 4, when one or a plurality of liquid advancing slits that communicate with the opening 2*u* at the rear end and extend frontward are provided in side surfaces (peripheral surfaces) of the rear portion supporting portions, the eyeliner cosmetic material L in the inner cotton 3 advances into the inside of the rear portion supporting portions through the liquid advancing slits, so that a larger amount of eyeliner cosmetic material L can be moved to the applying body 4. In this case, it is more preferable that the applying body 4 within the rear portion supporting portions advance into the liquid advancing slits, or advance into the inner cotton 3 on the outside through the liquid advancing slits, because an even larger amount of eyeliner cosmetic material L can be moved to the applying body 4.

In the first embodiment, the eyeliner cosmetic material applying container 100 of the type in which the flat applying body 4 is inserted into the inner cotton 3 as an impregnated body has been described above. In a second embodiment shown in subsequent FIGS. 10 to 19, description will be made of an eyeliner cosmetic material applying container of a type in which an impregnated body is inserted into a flat applying body.

Figure 10:
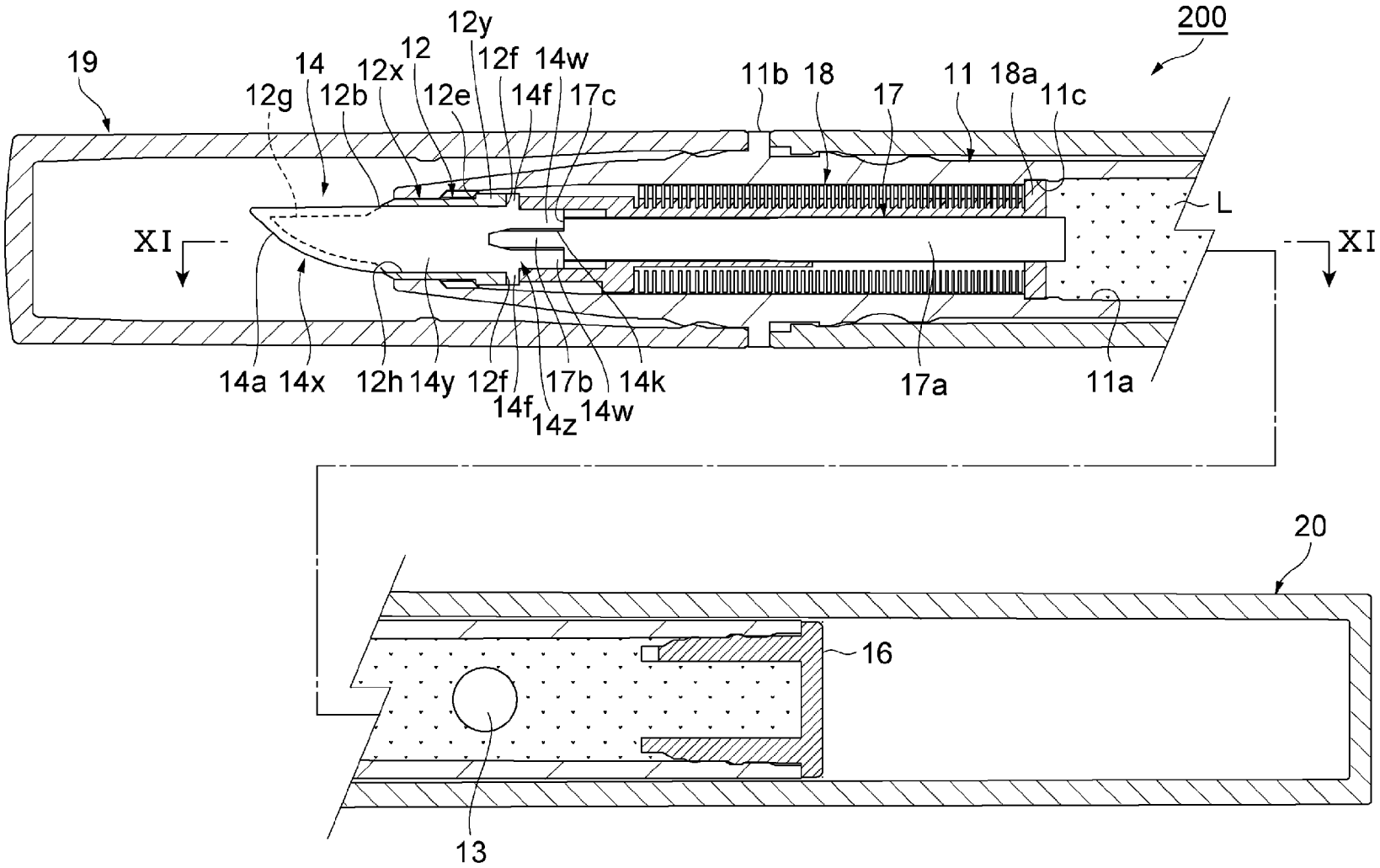
FIG. 10 is a longitudinal sectional view of a liquid applying container according to a second embodiment of the present disclosure.
Figure 11:
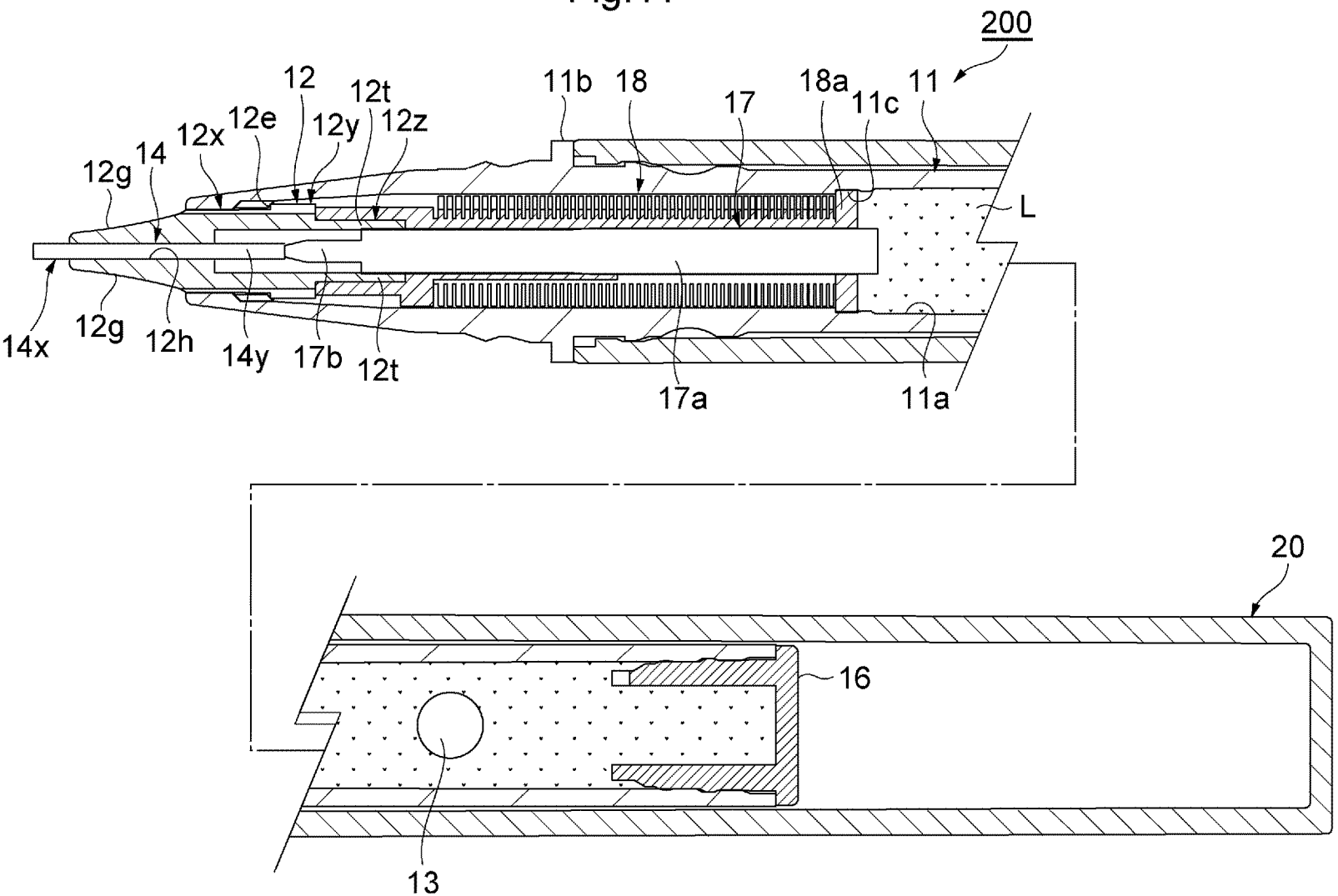
FIG. 11 is a view taken along a line XI-XI of FIG. 10 in the direction of the arrows.
Figure 12:
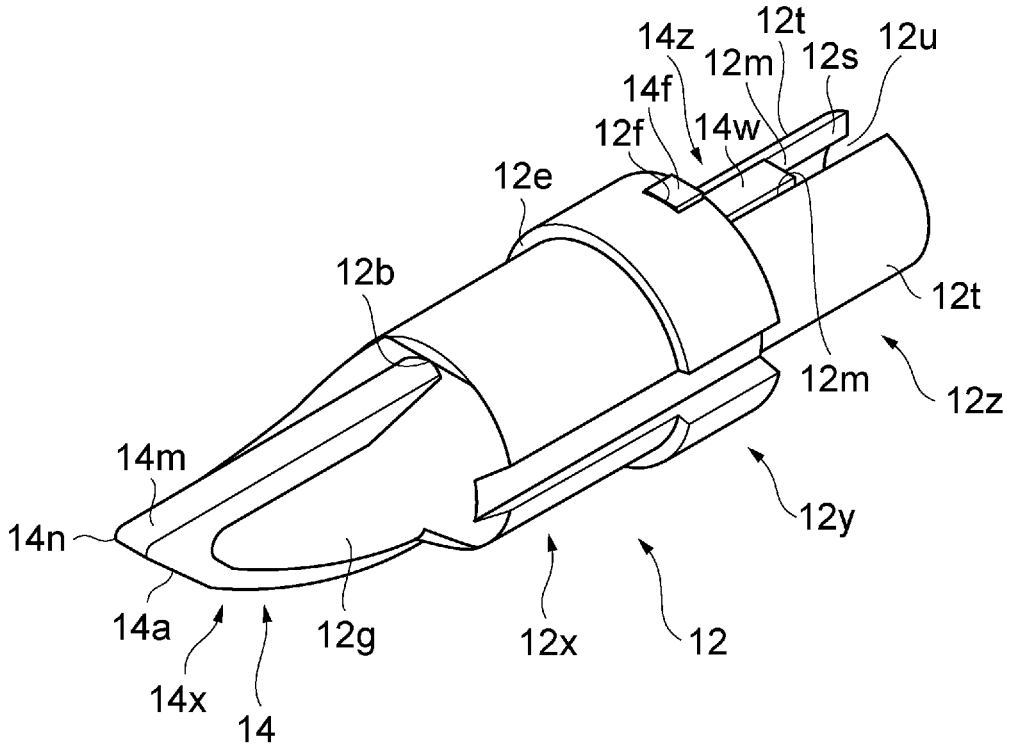
FIG. 12 is a perspective view of an applying body and an applying body holder in FIG. 10 and FIG. 11 as viewed from the front.
Figure 13:
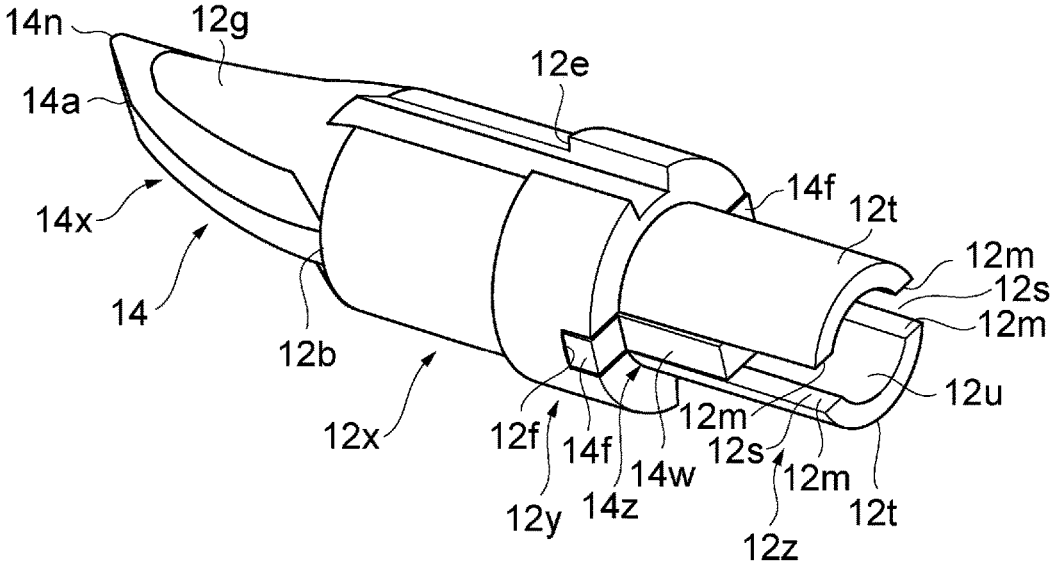
FIG. 13 is a perspective view of the applying body and the applying body holder shown in FIG. 12 as viewed from the rear.
Figure 14:
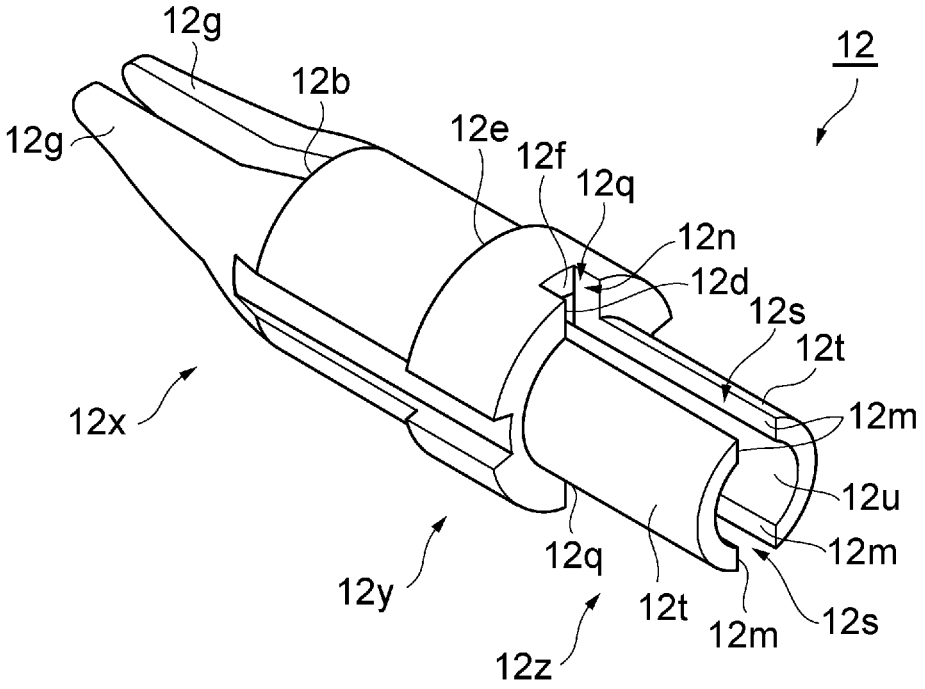
FIG. 14 is a perspective view of the applying body holder in FIG. 10 and FIG. 11 as viewed from the rear.
Figure 15:
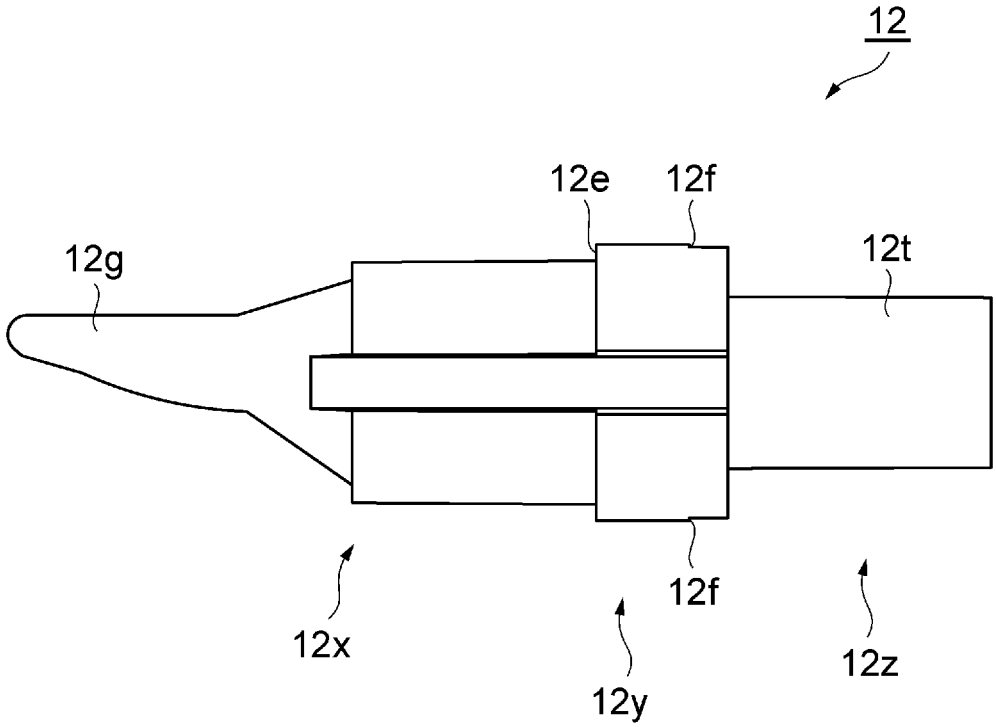
FIG. 15 is a side view of the applying body holder shown in FIG. 14.
Figure 16:
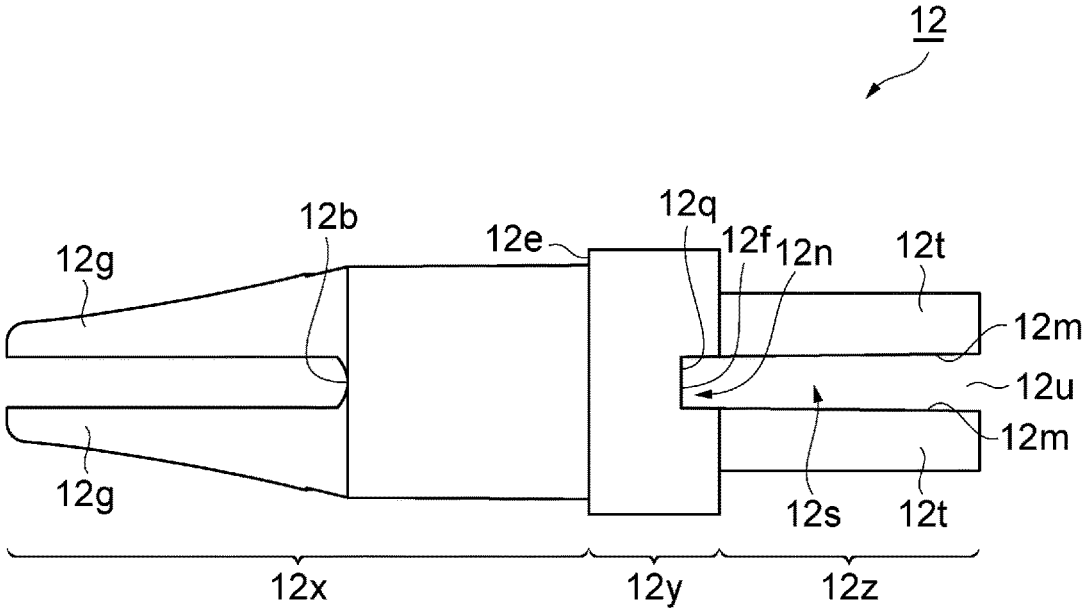
FIG. 16 is a plan view of the applying body holder shown in FIG. 15.

FIG. 10 and FIG. 11 are sectional views of a liquid applying container according to the second embodiment of the present disclosure. FIG. 12 and FIG. 13 are perspective views of an applying body and an applying body holder. FIGS. 14 to 16 are diagrams of the applying body holder.

Figure 17:
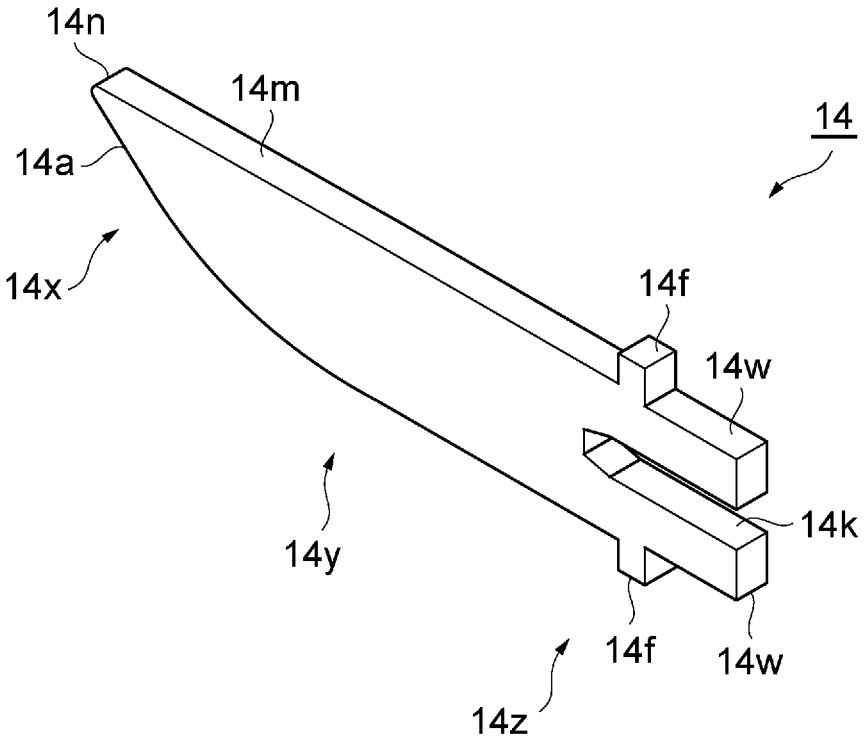
FIG. 17 is a perspective view of the applying body in FIG. 10 and FIG. 11.
Figure 18:
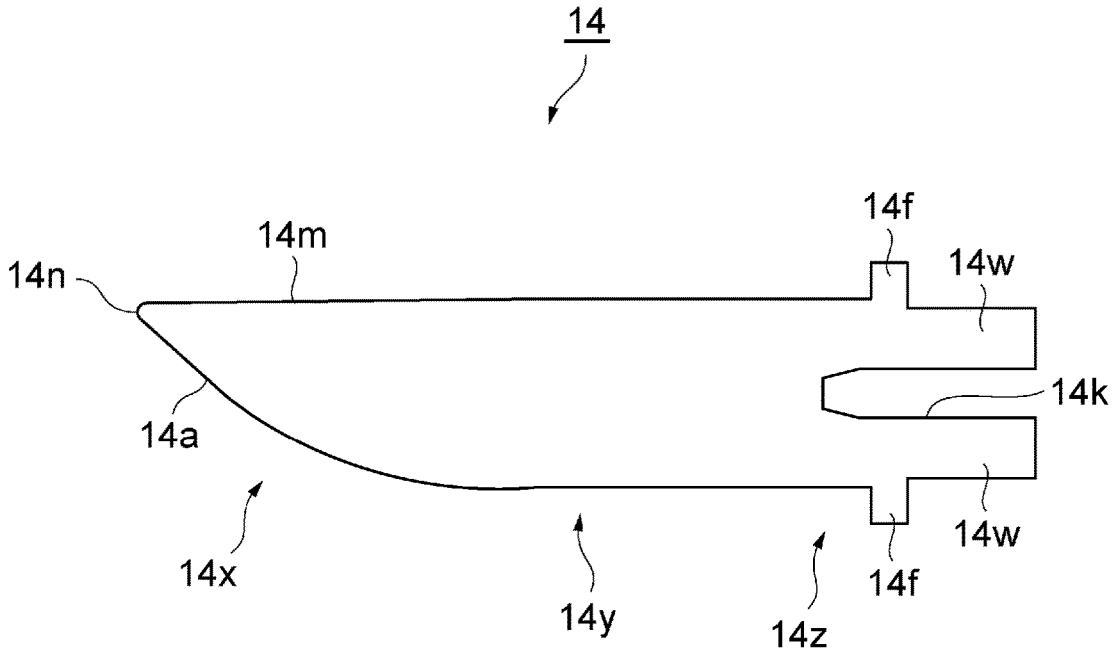
FIG. 18 is a side view of the applying body shown in FIG. 17.
Figure 19:
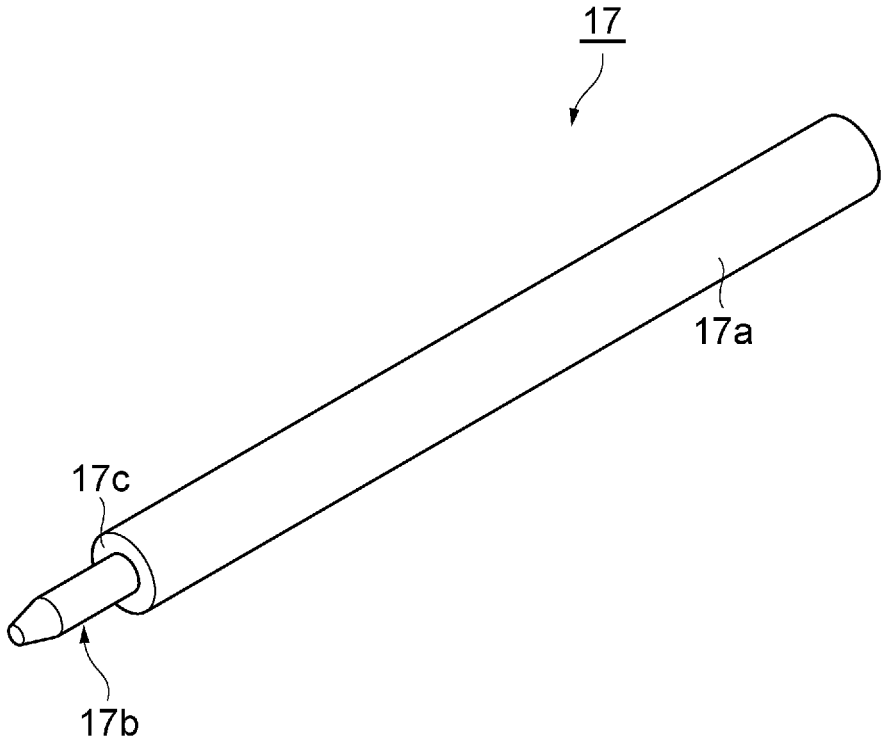
FIG. 19 is a perspective view of an impregnated body in FIG. 10 and FIG. 11.

FIG. 17 and FIG. 18 are diagrams of the applying body. FIG. 19 is a perspective view of an impregnated body. Also in the second embodiment, an eyeliner cosmetic material applying container holding an eyeliner cosmetic material as a liquid is used as a liquid applying container.

As shown in FIG. 10 and FIG. 11, an eyeliner cosmetic material applying container 200 includes a container main body 11 housing parts, a housing portion 11*a* provided in a rear half portion within the container main body 11 to house an eyeliner cosmetic material L, an applying body 14 projecting from a front end of the container main body 11 to apply the eyeliner cosmetic material L within the housing portion 11*a*, an applying body holder 12 supporting the applying body 14 and fitted to the container main body 11, a shaft-shaped relay core 17 as an impregnated body disposed within the container main body 11 and connecting the inside of the housing portion 11*a* to the applying body 14, and a substantially cylindrical bellows member 18 fitted around the relay core 17.

Incidentally, in this case, a holding tube 20 having the shape of a bottomed cylinder and having a long length in an axial direction is detachably or undetachably fitted to a rear side of the container main body 11 in order to facilitate application by a user holding the eyeliner cosmetic material applying container 200, and a cap 19 is detachably fitted to a front side of the container main body 11 to protect the applying body 14.

The container main body 11 is formed for example of PP or the like, and is configured in the shape of a tapered cylinder. An outer circumferential surface on a front end side of the container main body 11 is provided with an annular flange portion 11*b*. An opening at a rear end of the container main body 11 is closed by fitting a tail plug 16 formed for example of PP or the like into the rear end of the container main body 11. An internal space formed so as to have an increased diameter in the rear of the bellows member 18 within the container main body 11 is the housing portion 11*a* filled with the eyeliner cosmetic material L. The housing portion 11*a* houses, together with the eyeliner cosmetic material L, a spherical agitator 13 formed for example of steel use stainless (SUS) or the like to agitate the eyeliner cosmetic material L.

The applying body holder 12 is to support the applying body 14 in a state in which the applying body 14 is inserted in the applying body holder 12. The applying body holder 12 is formed for example of PP or the like. As shown in FIGS. 14 to 16, the applying body holder 12 includes a tip portion 12*x* on a front end side, a rear portion 12*z* on a rear end side, and an intermediate portion 12*y* between the tip portion 12*x* and the rear portion 12*z*. As shown in FIG. 10 and FIG. 11, tip portion supporting portions 12*g* and 12*g* (to be described later in detail) as projecting portions on the front end side of the tip portion 12*x* project from the container main body 11. A part of the tip portion 12*x* which part is in the rear of the tip portion supporting portions 12*g* and 12*g* as well as the intermediate portion 12*y* and the rear portion 12*z* is housed within the container main body 11.

As shown in FIGS. 14 to 16, the part of the tip portion 12*x* which part is in the rear of the tip portion supporting portions 12*g* and 12*g* and the intermediate portion 12*y* are configured in a tubular shape having a circular outer circumferential surface. A tube hole 12*h* (see FIG. 10 and FIG. 11) penetrating the part of the tip portion 12*x* which part is in the rear of the tip portion supporting portions 12*g* and 12*g* and the intermediate portion 12*y* includes a front half portion having a shape capable of housing an intermediate portion 14*y* (see FIG. 17 and FIG. 18: to be described later in detail) of the flat applying body 14, that is, a substantially rectangular cross-sectional shape corresponding to the shape of the intermediate portion 14*y* of the applying body 14. The tube hole 12*h* also includes a rear half portion continuous with the front half portion, the rear half portion having a substantially rectangular cross-sectional shape whose long diameter is the same as the long diameter of the front half portion (see FIG. 10), and whose short diameter is a same length as the diameter of a shaft portion 17*a*, which will be described later, of the relay core 17 (see FIG. 11).

As shown in FIGS. 14 to 16, an opening 12*b* at a front end of the part of the tip portion 12*x* which part is in the rear of the tip portion supporting portions 12*g* and 12*g* is an exit for the applying body 14, the exit being continuous with and similar in shape to the tube hole 12*h* of the substantially rectangular cross-sectional shape (see FIG. 10, FIG. 12, and FIG. 13). A pair of tip portion supporting portions 12*g* opposed to each other which supporting portions project forward of opening edges on a long diameter side (direction perpendicular to the paper plane of FIG. 16) of the opening 12*b* as the exit is provided at opening edges on a short diameter side (vertical direction of FIG. 16) of the opening 12*b*. The tip portion supporting portions 12*g* and 12*g* sandwich and support a tip portion 14*x*, which will be described later, of the applying body 14 from both sides. The tip portion supporting portions 12*g* and 12*g* have a tapered shape reduced in diameter in such a manner as to change into a flat shape toward the front end side. In addition, the tip portion supporting portions 12*g* and 12*g* have such a shape as to be substantially along an outer edge of the tip portion 14*x* of the applying body 14 (shape of the outer edge of the tip portion 14*x* of the applying body 14 will be described later).

The outer circumferential surface of the intermediate portion 12*y* has a large-diameter circular shape continuous with a rear end of the tip portion 12*x* via a stepped surface 12*e*. The intermediate portion 12*y* is a block body extending rearward by a short length. A rear end portion of the intermediate portion 12*y* is provided with a groove 12*n* depressed from a rear end surface of the intermediate portion 12*y* by a predetermined depth, the groove 12*n* overlapping the tube hole 12*h* of the substantially rectangular cross-sectional shape as viewed in an axial direction, the tube hole 12*h* penetrating the intermediate portion 12*y*, and the groove 12*n* extending on a long diameter side (direction perpendicular to the paper plane of FIG. 16) of the tube hole 12*h*. An opening 12*d* as a hole exit is formed at a position where the tube hole 12*h* penetrating the intermediate portion 12*y* intersects the groove 12*n*. Recessed portions 12*q* depressed frontward in the axial direction are formed by the groove 12*n* on the periphery on the long diameter side of the opening 12*d*. When the applying body 14 is assembled, stoppers 14*f* (to be described later in detail) of the applying body 14 advance into the recessed portions 12*q*. Bottom surfaces 12*f* of the recessed portions 12*q* are stoppers against which the stoppers 14*f* of the applying body 14 abut (the bottom surfaces 12*f* of the recessed portions 12*q* will hereinafter be referred to as stoppers 12*f*).

The rear portion 12*z* includes a pair of projecting portions 12*t* and 12*t* that are connected to the rear end surface of the intermediate portion 12*y* so as to be along a direction of insertion of the applying body 14, and which project rearward. These projecting portions 12*t* and 12*t* are rear portion supporting portions that sandwich and support a rear portion 14*z*, which will be described later, of the applying body 14 from both sides (the projecting portions 12*t* will hereinafter be referred to as rear portion supporting portions 12*t*). Each rear portion supporting portion 12*t* has a substantially semicylindrical cross-sectional shape obtained by halving a cylinder. End surfaces 12*m* and 12*m* on both sides of the substantially semicylindrical cross-sectional shape of one rear portion supporting portion 12*t* and end surfaces 12*m* and 12*m* on both sides of the substantially semicylindrical cross-sectional shape of the other rear portion supporting portion 12*t* are opposed to each other, and form surfaces that sandwich the rear portion 14*z* of the applying body 14 from both sides. The rear portion supporting portions 12*t* and 12*t* are arranged such that a short diameter side (vertical direction of FIG. 16) of the opening 12*d* is located between the rear portion supporting portions 12*t* and 12*t* of the substantially semicylindrical cross-sectional shape as viewed in the axial direction.

Because such a constitution is adopted, a slit 12*s* is formed between the end surface 12*m* on one side of the one rear portion supporting portion 12*t* and the end surface 12*m* on one side of the other rear portion supporting portion 12*t*, and a similar slit 12*s* is formed between the end surface 12*m* on the other side of the one rear portion supporting portion 12*t* and the end surface 12*m* on the other side of the other rear portion supporting portion 12*t*. The slits 12*s* and 12*s* are configured to linearly communicate with the respective recessed portions 12*q* provided in a depressed manner in the rear end surface of the intermediate portion 12*y*. In addition, a rear end between the rear portion supporting portions 12*t* and 12*t* is opened rearward, thus forming an opening 12*u*.

The applying body 14 is used to apply the eyeliner cosmetic material L along the edge of an eye. The applying body 14 is referred to also as a tip. As shown in FIG. 17 and FIG. 18, the applying body 14 is formed in the shape of a thin flat plate, and extends in an axial direction. The applying body 14 has an optimum thickness for drawing a thin line of eyeliner. The applying body 14 exhibits capillarity that takes in the eyeliner cosmetic material L from the relay core 17 and guides (moves) the eyeliner cosmetic material L to an applying portion 14*a* on the front end side. The applying body 14 in this case is formed of polyolefin so as to provide a skin-conforming soft touch at a time of application.

Incidentally, it suffices for the applying body 14 to be able to at least exhibit capillarity. However, the applying body 14 preferably provides a soft touch. A soft fibrous material or a soft porous material such as a sponge can be employed as the applying body 14. The applying body 14 may also be formed for example of nylon, polyester, or the like other than polyolefin. Incidentally, the applying body 14 is more preferably formed of a fibrous material.

This applying body 14 includes a tip portion 14*x* on the front end side, a rear portion 14*z* on the rear end side, and an intermediate portion 14*y* between the tip portion 14*x* and the rear portion 14*z*.

The tip portion 14*x* is a part projecting from the opening 12*b* of the applying body holder 12 (see FIG. 10). As viewed in plan (as viewed in a direction perpendicular to the paper plane of FIG. 18), the tip portion 14*x* assumes the shape of a tip portion (point) of the single-edged shape of for example a kitchen knife or the like. Specifically, as for the shape of an outer edge of the tip portion 14*x*, as viewed in plan, a part 14*m* corresponding to a so-called back that is a part on the back side of an edge of the single-edged shape is formed in a linear shape. A front end of the linear shape forms a sharp portion 14*n* pointed at an acute angle. As with the part of a so-called curve of the edge, a part from the sharp portion 14*n* toward the rear forms a curved inclined surface 14*a* that is curved and inclined. Then, the curved inclined surface 14*a* curved with a small thickness forms an applying portion for drawing a line of eyeliner (the curved inclined surface 14*a* will hereinafter be referred to as an applying portion 14*a*).

Incidentally, in this case, as a shape particularly preferable for applying the eyeliner cosmetic material L, the sharp portion 14*n* is disposed so as to be offset to one side (upper side in FIG. 18) in a width direction (vertical direction of FIG. 18) as viewed in plan as in the single-edged shape. However, the sharp portion 14*n* may be disposed at a center in the width direction as in a double-edged shape. In addition, while the applying portion 14*a* is curved and inclined, the applying portion 14*a* may be inclined linearly.

The intermediate portion 14*y* is continuous with a rear end of the tip portion 14*x*, and is formed in a substantially rectangular cross-sectional shape.

The rear portion 14*z* is a part that takes in the eyeliner cosmetic material L from the relay core 17 that advances into a rear end of the rear portion 14*z* (see FIG. 10). The rear portion 14*z* has a slit-shaped depression 14*k* depressed toward the front from a rear end surface of the rear portion 14*z* so that a front end projection 17*b* (to be described later in detail) of the relay core 17 is easily inserted. The rear side including the depression 14*k* is the rear portion 14*z* that takes in the eyeliner cosmetic material L from the relay core 17. The depression 14*k* that cuts in from the rear end divides the rear portion 14*z* into bifurcated projecting portions 14*w* and 14*w*. Both side surfaces (upper and lower surfaces in FIG. 18) on front end sides of the respective projecting portions 14*w* and 14*w* are provided with projecting portions 14*f* that project outward. The projecting portions 14*f* are stoppers that advance into the recessed portions 12*q* of the applying body holder 12 and which abut against the stoppers 12*f* of the applying body holder 12 when the applying body 14 is assembled to the applying body holder 12 (the projecting portions 14*f* will hereinafter be referred to as the stoppers 140.

As shown in FIG. 12 and FIG. 13, such a flat applying body 14 is inserted from the tip portion 14*x* into the opening 12*d* in the rear end surface of the intermediate portion 12*y* of the applying body holder 12 (see FIG. 14). As shown in FIG. 10, FIG. 12, and FIG. 13, the stoppers 14*f* as the projecting portions of the applying body 14 abut against the stoppers 12*f* of the intermediate portion 12*y* of the applying body holder 12. The applying body 14 is thus positioned and prevented from advancing further.

In this state, as shown in FIGS. 10 to 13, the tip portion 14*x* of the applying body 14 projects from the opening 12*b* of the tip portion 12*x* of the applying body holder 12, and is sandwiched and supported from both sides by the tip portion supporting portions 12*g* and 12*g* of the applying body holder 12, the tip portion supporting portions 12*g* and 12*g* having such an outer edge shape as to be substantially along (substantially a smaller similar shape to) the outer edge shape of the tip portion 14*x* of the applying body 14.

In addition, as shown in FIG. 12 and FIG. 13, the rear portion 14*z* of the applying body 14 is sandwiched and supported from both sides by the rear portion supporting portions 12*t* and 12*t* of the applying body holder 12. Specifically, one projecting portion 14*w* of the rear portion 14*z* is sandwiched between the end surface 12*m* on one side of the substantially semicylindrical cross-sectional shape of one rear portion supporting portion 12*t* and the end surface 12*m* on one side of the substantially semicylindrical cross-sectional shape of the other rear portion supporting portion 12*t*, and the other projecting portion 14*w* of the rear portion 14*z* is sandwiched between the end surface 12*m* on the other side of the substantially semicylindrical cross-sectional shape of the one rear portion supporting portion 12*t* and the end surface 12*m* on the other side of the substantially semicylindrical cross-sectional shape of the other rear portion supporting portion 12*t*. The rear portion 14*z* of the applying body 14 is thus supported.

Then, as shown in FIG. 10 and FIG. 11, the applying body holder 12 thus integrated with the applying body 14 is inserted from the front end side of the applying body holder 12 into a tube hole through the opening opened at the rear end of the container main body 11. The stepped surface 12*e* is butted against a stepped surface provided to an inner circumferential surface on the front end side of the container main body 11. The outer circumferential surface of the part in front of the stepped surface 12*e* is fitted to the inner circumferential surface in the front end of the container main body 11. The applying body holder 12 supporting the applying body 14 is thereby fitted to the container main body 11.

The bellows member 18 is to control the flow rate of the eyeliner cosmetic material L. The bellows member 18 is formed for example of PP or the like. The bellows member 18 is configured in a substantially cylindrical shape. Grooves (bellows) for containing the eyeliner cosmetic material L are provided in the rear of a front end portion of the bellows member 18 along the axial direction.

The relay core 17 is formed for example of polyethylene terephthalate (PET) or the like. As shown in FIG. 19, the relay core 17 is configured in the shape of a shaft having a circular cross section. The relay core 17 includes a shaft portion 17*a* that extends in the axial direction, and a projection 17*b* that is provided to a front end of the shaft portion 17*a* so as to be reduced in diameter via a stepped surface 17*c* and which projects frontward. As shown in FIG. 10 and FIG. 11, the shaft portion 17*a* of the relay core 17 passes through a tube hole of the bellows member 18. A front end side of the shaft portion 17*a* is fitted to a front end side of the bellows member 18. The relay core 17 is thereby fitted to the bellows member 18.

Then, the bellows member 18 thus integrated with the relay core 17 is inserted from the front end side of the bellows member 18 into the tube hole through the opening opened at the rear end of the container main body 11. A cylindrical rear end portion 18*a* of the bellows member 18 is fitted into a recessed portion 11*c* in the inner circumferential surface of the container main body 11. The bellows member 18 integrated with the relay core 17 is thereby fitted to the container main body 11.

In this state, the cylindrical front end portion of the bellows member 18 is butted against the rear end surface of the intermediate portion 12*y* of the applying body holder 12 (see FIG. 11). The stoppers 14*f* of the applying body 14 are rendered immovable in the axial direction in a state of being sandwiched between the stoppers 12*f* of the applying body holder 12 and a front end surface of the bellows member 18 (see FIG. 10). In addition, in this state, the stepped surface 17*c* of the relay core 17 is butted against the rear end surface of the applying body 14 (see FIG. 10), and the projection 17*b* of the relay core 17 advances through the opening 12*u* at the rear end of the rear portion 12*z* of the applying body holder 12 (see FIG. 13). Further, the projection 17*b* of the relay core 17 is inserted and advanced into the rear portion 14*z* of the applying body 14 which rear portion is sandwiched and supported by the rear portion supporting portions 12*t* and 12*t* of the applying body holder 12. Specifically, the projection 17*b* of the relay core 17 is inserted and advanced into the depression 14*k* formed between the projecting portions 14*w* and 14*w* of the rear portion 14*z* (see FIG. 10). In this state, the projection 17*b* of the relay core 17 is in contact with the rear portion 14*z* of the applying body 14.

Then, the above-described tail plug 16 is fitted into the opening in the rear of the rear end portion 18*a* of the bellows member 18 within the container main body 11. The above-described housing portion 11*a* is formed between the rear end portion 18*a* of the bellows member 18 and the tail plug 16. The housing portion 11*a* is filled with the eyeliner cosmetic material L.

A thus assembled unit is inserted from the rear end side of the unit into a tube hole of the holding tube 20. The flange portion 11*b* of the container main body 11 is butted against a front end surface of the holding tube 20. In this state, the outer circumferential surface in the rear of the flange portion 11*b* of the container main body 11 engages with an inner circumferential surface on a front end side of the holding tube 20. The unit is thereby fitted to the holding tube 20. The eyeliner cosmetic material applying container 200 shown in FIG. 10 and FIG. 11 is thus obtained.

In the thus formed eyeliner cosmetic material applying container 200, the eyeliner cosmetic material L within the container main body 11 is taken in from the rear portion of the relay core 17, passes through the shaft portion 17*a*, and moves to the front end projection 17*b*. Further, due to the capillarity of the applying body 14, the eyeliner cosmetic material L is taken in by the rear portion 14*z* of the applying body 14, the projection 17*b* being inserted in and in contact with the rear portion 14*z* of the applying body 14, moves through the applying body 14, and further moves to the applying portion 14*a* of the tip portion 14*x*. Thus, a thin line of eyeliner can be drawn by the applying portion 14*a* with a soft touch.

Such an eyeliner cosmetic material applying container 200, in particular, produces the following action and effect. The relay core 17 advances into the rear portion supporting portions 12*t* and 12*t* through the opening 12*u* at the rear end of the applying body holder 12 in the state in which the rear portion 14*z* of the applying body 14 that has the shape of a flat plate and exhibits capillarity is sandwiched and supported by the rear portion supporting portions 12*t* and 12*t* of the applying body holder 12. Thus, the relay core 17 that has advanced into the rear portion supporting portions 12*t* and 12*t* is easily inserted into the rear portion 14*z* of the applying body 14 while the rear portion supporting portions 12*t* and 12*t* of the applying body holder 12 prevent the rear portion 14*z* of the applying body 14 from escaping. Therefore, the eyeliner cosmetic material L in the relay core 17 can be surely moved to the applying body 14, and the eyeliner cosmetic material L flows straight forward through the opening 12*u* at the rear end of the rear portion supporting portions 12*t* and 12*t*, so that the eyeliner cosmetic material L in the relay core 17 can be moved smoothly.

In addition, according to the present embodiment, the applying body 14 is softer than the relay core 17. Thus, the relay core 17 can be surely inserted into the rear end surface of the rear portion 14*z* of the applying body 14 which rear portion is sandwiched and supported by the rear portion supporting portions 12*t* and 12*t* of the applying body holder 12.

In addition, the relay core 17 has the projection 17*b* provided at the front end thereof. The rear end surface of the applying body 14 is provided with the depression 14*k* into which the projection 17*b* of the relay core 17 advances. Thus, the projection 17*b* of the relay core 17 can be surely inserted and advanced into the depression 14*k* of the rear end surface of the applying body 14.

In addition, the slits 12*s* and 12*s* communicating with the opening 12*u* at the rear end of the applying body holder 12 and extending frontward are provided between the rear portion supporting portions 12*t* and 12*t* of the applying body holder 12, and the applying body holder 12 has the stoppers 12*f* and 12*f* against which to butt the applying body 14 that passes the slits 12*s* and 12*s* from the rear side to the front side (see FIG. 14). Thus, because the stoppers 14*f* and 14*f* of the applying body 14 abut against the stoppers 12*f* and 12*f* of the applying body holder 12 (see FIG. 10), the applying body 14 is positioned easily, and the applying body 14 is prevented from advancing further. The applying body 14 can thereby be prevented from slipping out frontward while cleaning such as taking dirt off the applying body 14 is performed in the state of the eyeliner cosmetic material applying container 200 shown in FIG. 10 and FIG. 11.

Further, according to the present embodiment, as described in the first embodiment, the tip portion 14*x* of the applying body 14 is sandwiched and supported from both sides by the tip portion supporting portions 12*g* and 12*g* of the applying body holder 12, the tip portion supporting portions 12*g* and 12*g* having such an outer edge shape as to be substantially along the outer edge shape of the tip portion 14*x* (see FIG. 12 and FIG. 13). The tip portion 14*x* of the applying body 14 can therefore be prevented from being bent by a stroke pressure when a line of eyeliner is drawn. Thus, a beautiful thin line of eyeliner having a desired width can be easily drawn by the applying portion 14*a* of the applying body 14 along the edge of an eye.

Incidentally, in the second embodiment, as a particularly preferable example, the rear portion supporting portions 12*t* and 12*t* of the applying body holder 12 have a substantially semicylindrical cross-sectional shape obtained by halving a cylinder, and the rear portion 14*z* (projecting portions 14*w* and 14*w*) of the flat applying body 14 is supported so as to be sandwiched between the end surfaces 12*m* and 12*m* on both sides of one substantially semicylindrical cross-sectional shape and the end surfaces 12*m* and 12*m* on both sides of the other substantially semicylindrical cross-sectional shape. However, a part of the rear portion 14*z* of the applying body 14 which part is exposed to the outside without being sandwiched or covered by the rear portion supporting portions 12*t* and 12*t* of the applying body holder 12 may be covered and supported so as to be wrapped. In addition, the substantially semicylindrical cross-sectional shapes of the rear portion supporting portions 12*t* and 12*t* may be changed to flat plate shapes, and the rear portion 14*z* of the flat applying body 14 may be supported so as to be sandwiched between the pair of flat rear portion supporting portions. In addition, the part exposed to the outside without being sandwiched by the flat rear portion supporting portion may be covered, and supported such that the entire periphery of the rear portion 14*z* of the applying body 14 is wrapped. These constitutions also produce action and effect substantially similar to those in the case where the rear portion 14*z* of the applying body 14 is sandwiched and supported by the rear portion supporting portions 12*t* and 12*t* of the applying body holder 12. In addition, in the cases of these constitutions, the applying body 14 may be a flat plate without the depression 14*k*.

The present disclosure has been concretely described above on the basis of embodiments thereof. However, the present disclosure is not limited to the foregoing embodiments. For example, in the foregoing embodiments, as a particularly preferable example, the applying bodies 4 and 14 have the shape of a flat plate. However, the applying bodies 4 and 14 may be in the shape of a bent plate.

In addition, the eyeliner cosmetic material applying containers 100 and 200 according to the foregoing embodiments may be provided with an extruding mechanism such for example as a pressurizing piston for extruding the eyeliner cosmetic material L to the front end side, and the extruding mechanism may be used as an aid for moving the eyeliner cosmetic material L to the front end side. The present disclosure is also applicable to eyeliner cosmetic material applying containers of a squeeze type such as a tube or a soft bottle that allows the eyeliner cosmetic material L to be squeezed out by a pressing force of the user.

In addition, in the foregoing embodiments, as a particularly preferable example, the liquid is the eyeliner cosmetic material L, and the container is the eyeliner cosmetic material applying container 100 or 200. However, the liquid may be another liquid cosmetic material such for example as an eyebrow pencil or hair mascara, and the container may be another liquid cosmetic material applying container. Further, the liquid can be an ink for a writing instrument or the like, a glue, or a liquid medicine, and the container can be a liquid applying container

What is claimed is:

1. A liquid applying container comprising:

a container main body housing an impregnated body impregnated with a liquid;

an applying body having an applying portion for applying the liquid, and exhibiting capillarity that takes in the liquid from the impregnated body and guides the liquid to the applying portion; and an applying body holder into which the applying body is inserted and which supports the applying body, the applying body including a tip portion in which the applying portion is formed and which projects outward from the container main body and a rear portion that takes in the liquid from the impregnated body, wherein the applying body is formed in a shape of a plate, and the applying body holder includes one or a plurality of supporting portions in a rear portion of the applying body holder, the one or a plurality of supporting portions being disposed so as to be along a direction of insertion of the applying body and supporting the rear portion of the applying body so as to sandwich or wrap the rear portion of the applying body, the one or a plurality of supporting portions having an opening formed at a rear end of the one or a plurality of supporting portions, and the one or a plurality of supporting portions advancing into the impregnated body or the impregnated body advancing into the one or a plurality of supporting portions.

2. The liquid applying container according to claim 1, wherein the applying body is formed of a fibrous material.

3. The liquid applying container according to claim 1, wherein when the one or a plurality of supporting portions advance into the impregnated body, the impregnated body is an inner cotton.

4. The liquid applying container according to claim 3, wherein the applying body projects rearward from the opening at the rear end of the applying body holder.

5. The liquid applying container according to claim 3, wherein when the one or a plurality of supporting portions support the rear portion of the applying body so as to wrap the rear portion of the applying body, the one or a plurality of supporting portions have a liquid advancing slit in side surfaces of the one or a plurality of supporting portions, the liquid advancing slit communicating with the opening at the rear end and extending frontward.

6. The liquid applying container according to claim 4, wherein when the one or a plurality of supporting portions support the rear portion of the applying body so as to wrap the rear portion of the applying body, the one or a plurality of supporting portions have a liquid advancing slit in side surfaces of the one or a plurality of supporting portions, the liquid advancing slit communicating with the opening at the rear end and extending frontward.

7. The liquid applying container according to claim 1, wherein when the impregnated body advances into the one or a plurality of supporting portions, the impregnated body is a relay core.

8. The liquid applying container according to claim 7, wherein the relay core has a projection at a front end of the relay core, and a rear end surface of the applying body has a depression into which the projection of the relay core advances.

9. The liquid applying container according to claim 3, wherein when the one or a plurality of supporting portions support the rear portion of the applying body so as to sandwich the rear portion of the applying body, a slit communicating with the opening at the rear end and extending frontward is provided between the one or a plurality of supporting portions, and the applying body holder has a stopper against which the applying body passing the slit from a rear side to a front side is butted.

10. The liquid applying container according to claim 4, wherein when the one or a plurality of supporting portions support the rear portion of the applying body so as to sandwich the rear portion of the applying body, a slit communicating with the opening at the rear end and extending frontward is provided between the one or a plurality of supporting portions, and the applying body holder has a stopper against which the applying body passing the slit from a rear side to a front side is butted.

11. The liquid applying container according to claim 7, wherein when the one or a plurality of supporting portions support the rear portion of the applying body so as to sandwich the rear portion of the applying body, a slit communicating with the opening at the rear end and extending frontward is provided between the one or a plurality of supporting portions, and the applying body holder has a stopper against which the applying body passing the slit from a rear side to a front side is butted.

12. The liquid applying container according to claim 8, wherein when the one or a plurality of supporting portions support the rear portion of the applying body so as to sandwich the rear portion of the applying body, a slit communicating with the opening at the rear end and extending frontward is provided between the one or a plurality of supporting portions, and the applying body holder has a stopper against which the applying body passing the slit from a rear side to a front side is butted.

13. The liquid applying container according to claim 1, wherein the liquid is an eyeliner cosmetic material.

* * * * *